US005215871A

United States Patent [19]

Sato et al.

[11] Patent Number: 5,215,871

[45] Date of Patent: Jun. 1, 1993

[54] METHOD OF FORMING CYAN IMAGE WITH CYAN DYE FORMING COUPLER, AND SILVER HALIDE COLOR PHOTOGRAPHIC MATERIAL CONTAINING THE CYAN DYE FORMING COUPLER

[75] Inventors: Kozo Sato; Yoshio Ishii, both of Kanagawa, Japan

[73] Assignee: Fuji Photo Film Co., Ltd., Kanagawa, Japan

[21] Appl. No.: 789,020

[22] Filed: Nov. 7, 1991

[30] Foreign Application Priority Data

Nov. 7, 1990 [JP] Japan ..... 2-302078

[51] Int. Cl.[5] ..... G03C 7/38

[52] U.S. Cl. ..... 430/384; 430/385; 430/558

[58] Field of Search ..... 430/556, 557, 558, 384, 430/385

[56] References Cited

U.S. PATENT DOCUMENTS 4,910,127 3/1990 Sakaki et al. ..... 430/546

FOREIGN PATENT DOCUMENTS 62-278552 12/1987 Japan .

3141057 6/1988 Japan ..... 430/558

*Primary Examiner*—Lee C. Wright

*Attorney, Agent, or Firm*—Sughrue, Mion, Zinn, Macpeak & Seas

[57] ABSTRACT

A method of forming a cyan dye image in an exposed silver halide color photographic material comprising a support and a photosensitive silver halide emulsion, said method comprising developing the exposed silver halide color photographic material with a color developing solution containing an aromatic primary amine color developing agent in the presence of a cyan coupler represented by formula (I):

(I)

wherein $EWG_1$ and $EWG_2$ each represents an electron attractive group having a Hammett's substituent constant $\sigma_p$ value of at least 0.30 or;

$R_1$ represents a hydrogen atom or a substituent;

$R_2$ represents a substituent;

X represents a hydrogen atom or a group capable of splitting off by a coupling reaction with an oxidation product of an aromatic primary amine color developing agent;

$R_1$ and $R_2$ may be bonded to each other to form a ring; provided that $R_2$ must not be a halogen atom; and a silver halide color photographic material containing the cyan dye forming coupler.

20 Claims, No Drawings

METHOD OF FORMING CYAN IMAGE WITH CYAN DYE FORMING COUPLER, AND SILVER HALIDE COLOR PHOTOGRAPHIC MATERIAL CONTAINING THE CYAN DYE FORMING COUPLER

FIELD OF THE INVENTION

The present invention relates to a method of forming a cyan dye image with a novel cyan dye coupler and a silver halide color photographic material containing such a coupler.

BACKGROUND OF THE INVENTION

In processing a silver halide color photographic material containing yellow, magenta and cyan dye forming couplers, a system of forming a color image by a subtractive color process using a coupling reaction of the coupler with an oxidation product of an aromatic primary amine developing agent to form the corresponding dyes is most widely utilized.

Recently, studies for improvement of dye forming couplers have been effected actively in the technical field of preparing silver halide color photographic materials for the purpose of improving the color reproducibility and of improving the fastness of the images. However, it is hard to say that sufficient improvement has heretofore been attained because of the limitation of color developing agents. Regarding cyan couplers, phenol or naphthol couplers have been used essentially up to this time. However, the dyes to be formed from these couplers often have an unwanted absorption in the blue and green ranges, which is a great bar to improvement of the color reproducibility.

Recently, studies of new cyan dye forming couplers having a skeleton of a nitrogen-containing heterocyclic structure have been carried out actively, and various heterocyclic compounds have been proposed. For instance, JP-A-63-226653 (corresponding to U.S. Pat. No. 4,818,672) mentions diphenylimidazole couplers; and JP-A-63-199352, 63-250649 (corresponding to U.S. Pat. No. 4,916,051), 63-250650 (corresponding to U.S. Pat. No. 4,916,051), 64-554 (corresponding to U.S. Pat. No. 4,873,183), 64-555 (corresponding to U.S. Pat. No. 4,873,183), 1-105250 and 1-105251 mention pyrazoloazole couplers. (The term "JP-A" as used herein means an "unexamined published Japanese patent application".) All of these couplers are said to have an improved color reproducibility, and they are characterized by an excellent absorption characteristic.

However, these couplers have a drawback that the dyes to be formed therefrom absorb short-wave lights and are hardly fast to heat and light. In addition, they have another serious problem for practical use in that the coupling activity of the couplers is small.

JP-A-62-278552 mentions pyrroloimidazole magenta couplers. However, the couplers from dyes which absorb short-wave lights, as they have no electron-attracting group at the 6- and 7-positions, and they could not be cyan couplers.

SUMMARY OF THE INVENTION

A first object of the present invention is to provide a method of forming a cyan dye image which has an excellent color reproducibility and has an excellent color fastness, the method being therefore free from the above-mentioned problems of the conventional cyan couplers.

A second object of the present invention is to provide a silver halide color photographic material which forms a fast color image with an excellent color reproducibility, the material being therefore free from the above-mentioned problems of the conventional cyan couplers.

The above and other objects of the present invention can be attained by a method comprising developing an exposed silver halide color photographic material comprising a support and a photosensitive silver halide emulsion with a color developing solution containing an aromatic primary amine color developing agent in the presence of a cyan coupler represented by formula (I):

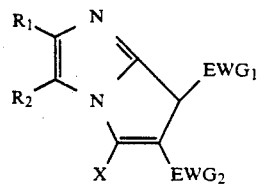

(I)

where $EWG_1$ and $EWG_2$ each represents an electron attractive group having a Hammett's substituent constant $\sigma_p$ value of at least 0.30;

$R_1$ represents a hydrogen atom or a substituent;

$R_2$ represents a substituent;

X represents a hydrogen atom or a group capable of splitting off by a coupling reaction with an oxidation product of an aromatic primary amine color developing agent (hereinafter referred to as a "split-off group"); and $R_1$ and $R_2$ may be bonded to each other to form a ring; and provided that $R_2$ must not be a halogen atom.

There is further provided in accordance with the present invention a silver halide color photographic material comprising a support and at least one silver halide emulsion layer containing at least one cyan dye forming coupler represented by formula (I).

DETAILED DESCRIPTION OF THE INVENTION

In formula (I), $EWG_1$ and $EWG_2$ each represents an electron attracting group having a Hammett's substituent constant $\sigma_p$ value of at least 0.30, preferably the $\sigma_p$ value of at least one of $EWG_1$ and $EWG_2$ is at least 0.50, and the $\sigma_p$ value preferably not more than 1.0 and more preferably not more than 0.75. $EWG_1$ and $EWG_2$ do not split off from the coupler by a reaction with an oxidation product of an aromatic primary amine compound.

As the Hammett's substituent constant $\sigma_p$ value as referred to herein, the value as described in Hansch, C. Leo et al's report (for example, *J. Med. Chem.*, 16, 1207 (1973); ibid., 20, 304 (1977)) is preferably employed.

As the electron attractive group (including atom) having a Hammett's substituent constant $\sigma_p$ value of 0.30 or more, there are preferably mentioned a cyano group, a nitro group, an aliphatic- or aromatic-acyl group (preferably $C_{1-20}$; e.g., formyl, acetyl, benzoyl), a carbamoyl group (preferably $C_{1-18}$; e.g., carbamoyl, methylcarbamoyl, octylcarbamoyl, o-tetradecoxyphenylcarbamoyl), a phosphono group (preferably $C_{2-12}$), an alkoxycarbonyl group (preferably $C_{2-19}$; e.g., methoxycarbonyl, ethoxycarbonyl, diphenylmethylcarbonyl), a phosphoryl group (preferably $C_{2-36}$; e.g., dimethoxyphosphoryl, diphenylphosphoryl), a sulfamoyl group (preferably $C_{0-24}$; e.g., N-ethylsulfamoyl, N,N-dipropylsulfamoyl), an aliphatic- or aromatic-sulfonyl group (preferably $C_{1-30}$; e.g., trifluoromethanesulfonyl, difluoromethanesulfonyl, methanesulfonyl, hexadecanesulfonyl, benzenesulfonyl, toluenesulfonyl), and a perfluoroalkyl group (preferably $C_{1-8}$). As shown above in examples, these groups may be substituted with at least one of substituents such as a halogen atom (e.g., F, Cl and Br), a hydroxy group, a cyano group, a carboxy group, an alkyl group, a cycloalkyl group, an aralkyl group, an aryl group, a heterocyclic group, an alkoxy group, an aryloxy group, an amino group, an acylamino group, an aliphatic- or an aromatic-sulfonylamino group, an acyl group, an aliphatic- or an aromatic-sulfonyl group, a carbamoyl group, a sulfamoyl group, a ureido group, an urethane group, an alkylthio group, an arylthio group, a nitro group, and an alkoxycarbonyl group. These substituents may be further substituted with at least one of the above described substituents.

Of them, preferred are a cyano group, an aliphatic- or aromatic-sulfonyl group, an aliphatic- or aromatic-acyl group, a perfluoroalkyl group, an aliphatic- or aromatic-carbamoyl group, and an alkoxycarbonyl group. More preferred are a cyano group, a perfluoroalkyl group, and an aliphatic or aromatic carbamoyl group.

In the present invention a heterocyclic group is (unless otherwise indicated) preferably a 5 to 7-membered heterocyclic group containing at least one of N, O and S atoms with the proviso that the total numbers of N atom, O atom and S atom are 1 to 4, 0 to 1, and 0 to 1, respectively; and an acyl moiety represents an aliphatic- or aromatic- acyl moiety.

$R_2$ is, for example, an aliphatic group having from 1 to 36 carbon atoms, an aromatic group preferably having from 6 to 36 carbon atoms (e.g., phenyl, 4-chlorophenyl, 4-hexyloxyphenyl, naphthyl; number of substituents is 0 to 5 which may be substituted at any position), a heterocyclic group (preferably $C_{0-36}$; e.g., 3-pyridyl, 2-furyl, 2-thienyl), an alkoxy group (preferably $C_{1-36}$; e.g., methoxy, 2-methoxyethoxy), an aryloxy group (preferably $C_{6-36}$; e.g., 2,4-di-tert-amylphenoxy, 2-chlorophenoxy, 4-cyanophenoxy), an alkenyloxy group (preferably $C_{2-36}$; e.g., 2-propenyloxy), an amino group (preferably $C_{0-36}$; e.g., butylamino, dimethylamino, anilino, N-methylanilino), an acyl group (preferably $C_{2-36}$; e.g., acetyl, benzoyl), an ester group (in the present invention an ester group represents an alkoxycarbonyl group, an aryloxycarbonyl group, an acyloxy group, an alkoxysulfonyl group, an aryloxysulfonyl group, an aliphatic or aromatic sulfonyloxy group; preferably having $C_{2-36}$; e.g., butoxycarbonyl, phenoxycarbonyl, acetoxy, benzoyloxy, butoxysulfonyl, toluenesulfonyloxy), an amido group (in the present invention an amido group represents an acylamino group, an alipahtic- or aromatic-sulfonylamino group, a carbamoyl group or a sulfamoyl group; preferably having $C_{1-36}$; e.g., acetylamino, ethylcarbamoyl, dimethylcarbamoyl, methanesulfonamido, butylsulfamoyl), a sulfamoylamino group (preferably having $C_{1-36}$; e.g., dipropylsulfamoylamino), an imido group (preferably having $C_{1-36}$; e.g., succinimido, hydantoinyl), an ureido group (preferably having $C_{1-36}$; e.g., phenylureido, dimethylureido), an aliphatic- or aromatic-sulfonyl group (preferably having $C_{1-36}$; e g., methanesulfonyl, phenylsulfonyl), an aliphatic- or aromatic-thio group (preferably having $C_{1-36}$; e.g., ethylthio, phenylthio), a hydroxyl group, a cyano group, a carboxyl group, a nitro group or a sulfo group. As shown above in examples, these groups may be substituted with at least one of substituents disclosed for the electron attracting group having $\sigma_p$ of 0.30 or more.

$R_1$ and $R_2$ may be bonded to each other to form a ring such as an aromatic ring (e.g., phenyl, naphthyl, phenanthryl which may be substituted).

$R_1$ represents a halogen atom (e.g , chlorine, fluorine, bromine) or a hydrogen atom, in addition to the substituents which were described for $R_2$. Preferably, $R_1$ and $R_2$ independently represent an aliphatic group, an aromatic group, a heterocyclic group, a cyano group or an alkoxy group.

In the present invention, an aliphatic group represents a linear, branched or cyclic aliphatic hydrocarbon group, which includes saturated or unsaturated groups, such as alkyl, alkenyl and alkynyl groups, and substituted or unsubstituted groups. Specific examples of these groups are methyl, ethyl, dodecyl, octadecyl, eicosenyl, iso-propyl, tert-butyl, tert-octyl, tert-dodecyl, cyclohexyl, cyclopentyl, allyl, vinyl, 2-hexadecenyl and propargyl groups; and aromatic group represents, for example, substituted or unsubstituted phenyl, naphthyl or phenanthryl group.

X represents a hydrogen atom or a split-off group.

As specific examples of the split-off group, there are mentioned a halogen atom (e.g., fluorine, chlorine, bromine), an alkoxy group (e.g., ethoxy, dodecyloxy, methoxyethylcarbamoylmethoxy, carboxypropoxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), an aliphatic or aromatic sulfonyloxy group (e.g., methanesulfonyloxy, toluenesulfonyloxy), an acylamino group (e.g., dichloroacetylamino, heptafluorobutyrylamino), an aliphatic or aromatic sulfonamido group (e.g., methanesulfonamido, p-toluenesulfonamido), an alkoxycarbonyloxy group (e.g., ethoxycarbonyloxy, benzyloxycarbonyloxy), an aryloxycarbonyloxy group (e.g., phenoxycarbonyloxy), an aliphatic, aromatic or heterocyclic thio group (e.g., ethylthio, phenylthio, tetrazolylthio), a carbamoylamino group (e.g., N-methylcarbamoylamino, N-phenylcarbamoylamino), a 5-membered or 6-membered nitrogen-containing heterocyclic group (preferably containing 1 to 4 nitrogen atoms as hetero atom; e.g., imidazolyl, pyrazolyl, triazolyl, 1,2-dihydro-2-oxo-1-pyridyl), an imido group (e.g., succinimido, hydantoinyl), an aromatic azo group (e.g., phenylazo), and a carboxyl group. These groups may optionally be substituted by one or more substituents which can be selected from those mentioned for $R_1$. X may also be a split-off group which is bonded to the remainder of formula (I) via a carbon atom. As examples of such a split-off group, there are mentioned residues of bis-type couplers to be obtained by condensation of 4-equivalent couplers with aldehydes or ketones. The split-off group for use in the present invention can contain a photographically useful group such as a development inhibitor or a development accelerator.

The coupler of the present invention is able to provide a dye having a maximum obsorption wavelength of about 580 to 720 nm by reacting the coupler with an aromatic primary amine color developing agent.

Couplers of formula (I) can be used as either so-called coupler-in-emulsion type couplers which are incorporated into silver halide color photographic materials or so-called coupler-in-developer type couplers which are incorporated into color developers. Where they are used as coupler-in-emulsion type couplers, at least one of $R_1$, $R_2$, $EWG_1$, $EWG_2$ and X has a total carbon number of from 10 to 50.

Specific examples of cyan couplers of formula (I) of the present invention are set forth below, as Couplers (1) to (34), which, however, are not limitative.

(1)

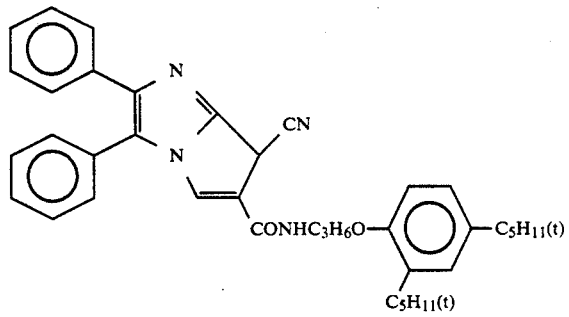

(2)

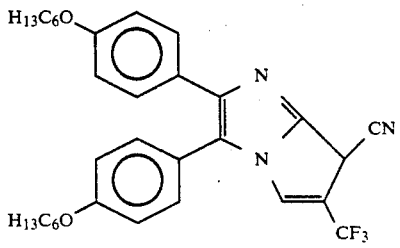

(3)

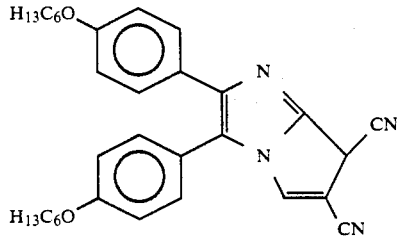

(4)

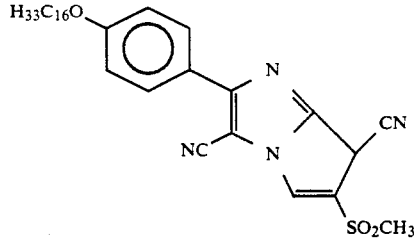

(5)

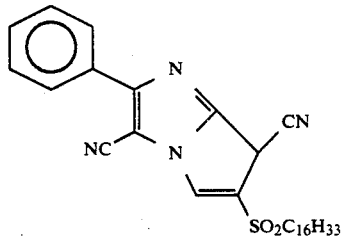

(6)

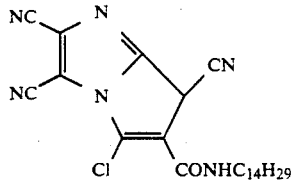

-continued
(7)
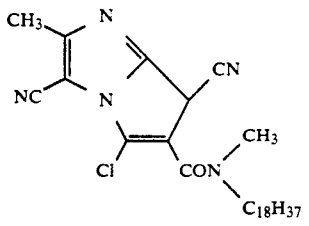
(8)
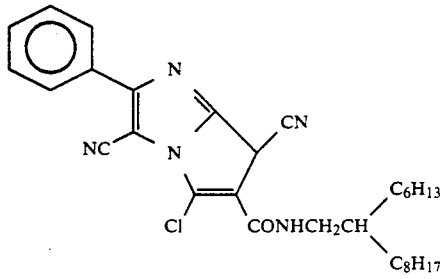
(9)
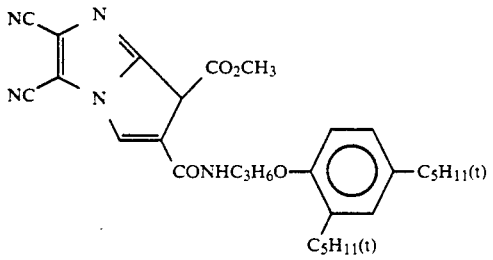
(10)
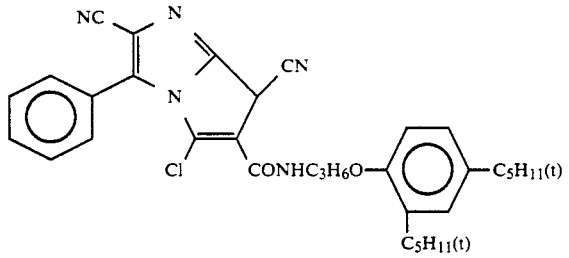
(12)
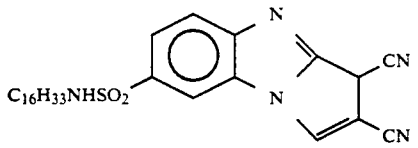
(13)
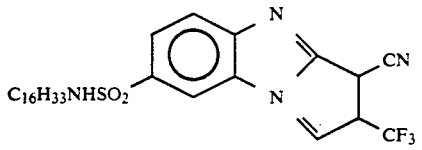
(14)
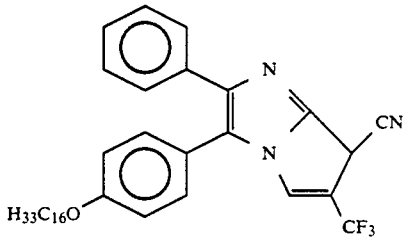

-continued
(15)
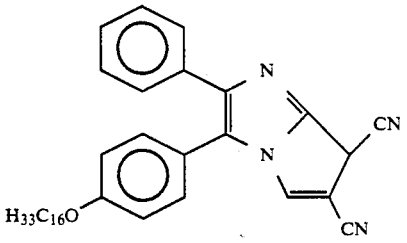
(16)
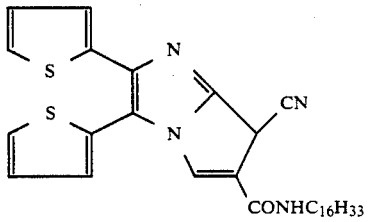
(17)
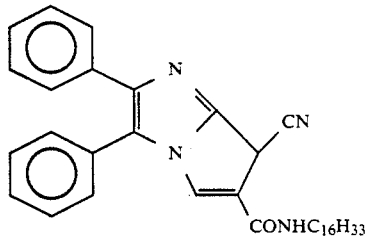
(18)
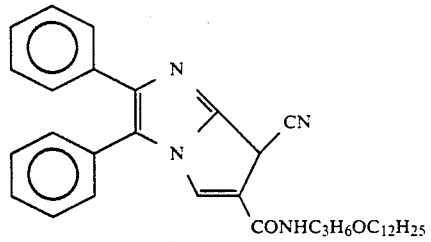
(19)
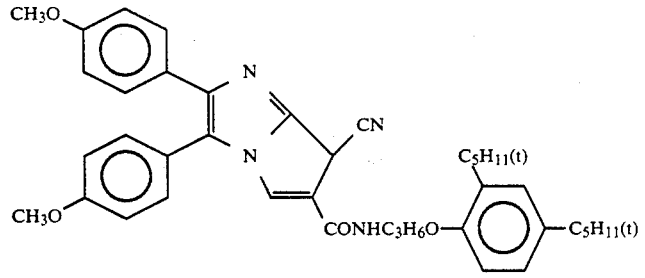
(20)
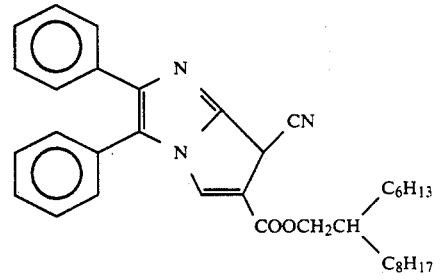

-continued
(21)
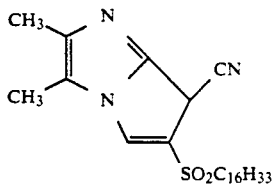
(22)
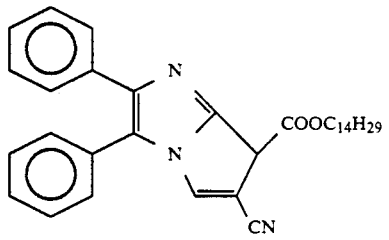
(23)
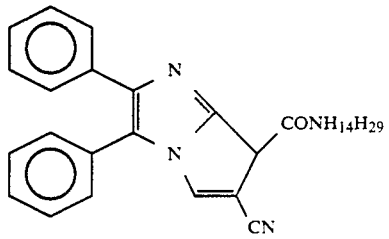
(24)
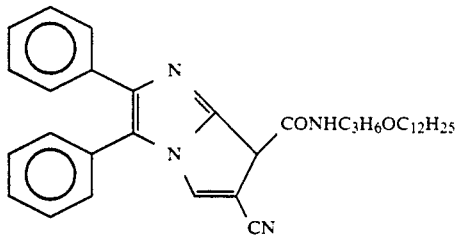
(25)
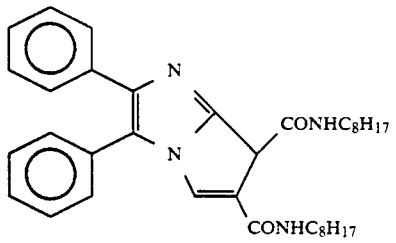
(26)
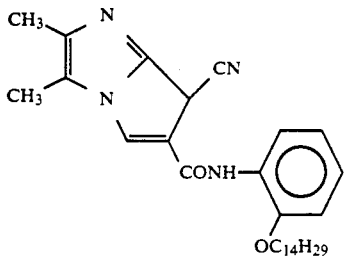

-continued
(27)
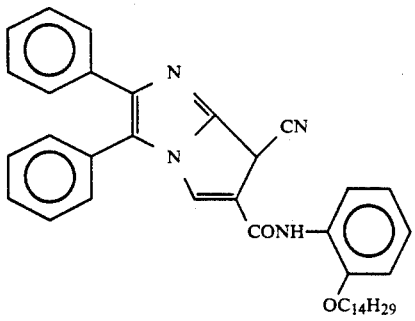
(28)
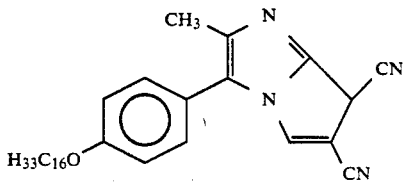
(29)
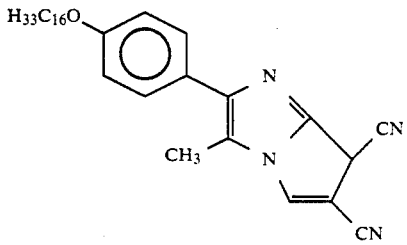
(30)
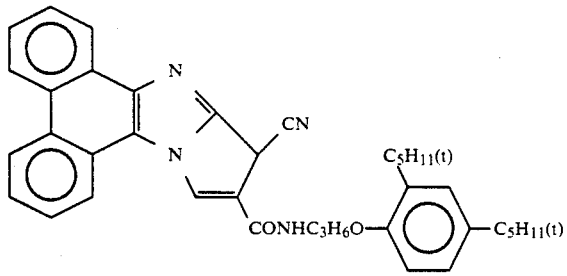
(31)
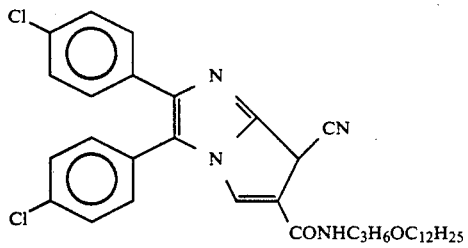
(32)
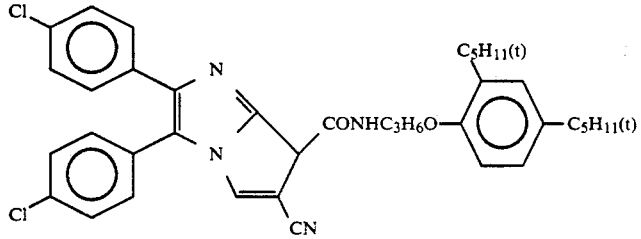

-continued (33)

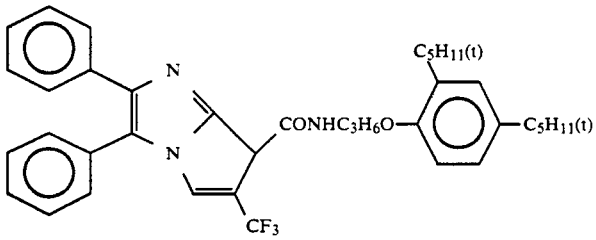

(34)

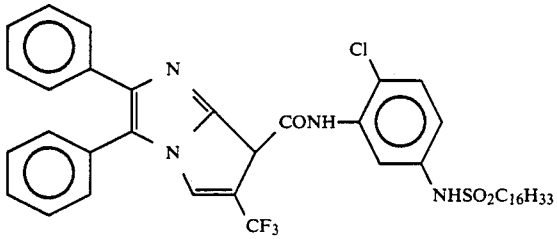

Next, methods of producing dye forming couplers of formula (I) of the present invention will be mentioned below.

1H-pyrrolo[1,2-b]-imidazole compounds of the present invention are produced by two methods; one method comprising first forming an imidazole ring skeleton and thereafter condensing a pyrrole ring moiety thereto, and the other method comprising first forming a pyrrole ring skeleton and thereafter condensing an imidazole ring moiety thereto. Specific examples of each of these two methods will be mentioned below.

SYNTHESIS EXAMPLE 1

Method 1-Production of Coupler (1)

Production Route

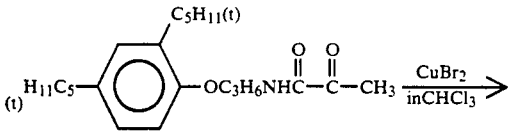

(A)

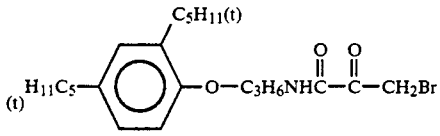

(B)

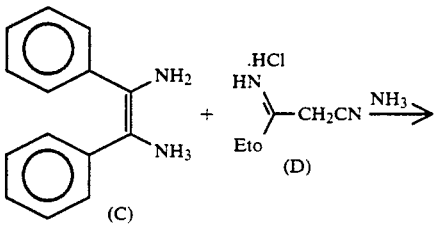

(C) (D)

-continued

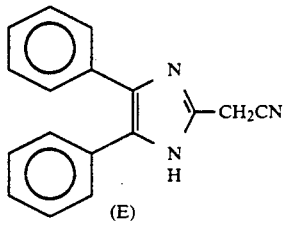

(E)

(B) + (E) $\xrightarrow{CH_3ONa}$

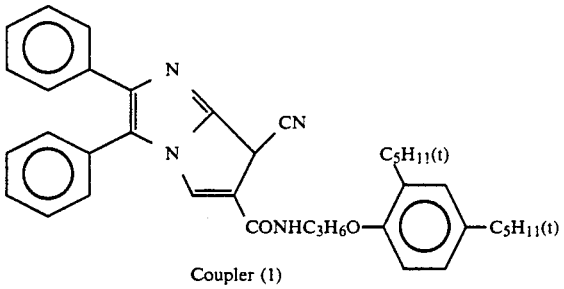

Coupler (1)

In accordance with the process described in *Journal of Organic Chemistry*, Vol. 29, 3459 (1964), 30 g of Compound (A) was brominated with an equivalent amount of cupric bromide in 200 ml of chloroform to obtain 25.8 g of Compound (B).

On the other hand, 21.1 g of 1,2-diamino-1,2-diphenylethylene (Compound (C)) and 22.3 g of malonnitrile monoimidate hydrochloride (Compound (D)) were added to 500 ml of ethanol which was saturated with ammonia, and heated at 50° C. for 6 hours. After standing to cool to room temperature, ethanol was removed by distillation under reduced pressure, 100 ml of 50% ethanol was added to the residue, and the crystal formed was taken out by filtration to obtain 18.5 g of 4,5-diphenyl-2-cyanomethylimidazole (Compound (E)).

13.0 g of Compound (E) and 25.8 g of Compound (B) were dissolved in 150 ml of dimethylacetamide, and 20 g of methanolic sodium methoxide (28%) was dropwise added thereto at room temperature. The whole was stirred for 2 hours at room temperature, and the reaction solution was poured into a cold diluted hydrochloric acid, which was then extracted with ethyl acetate. The extract was washed with water and dried, and the solvent was removed by distillation under reduced pressure. The residue was purified by silica gel chromatography (with an eluent of n-hexane/ethyl acetate of 2/1 by volume) to obtain 10.6 g of a white crystal of Coupler (1).

SYNTHESIS EXAMPLE 2

Method 2-Production of Coupler (3)

Production Route

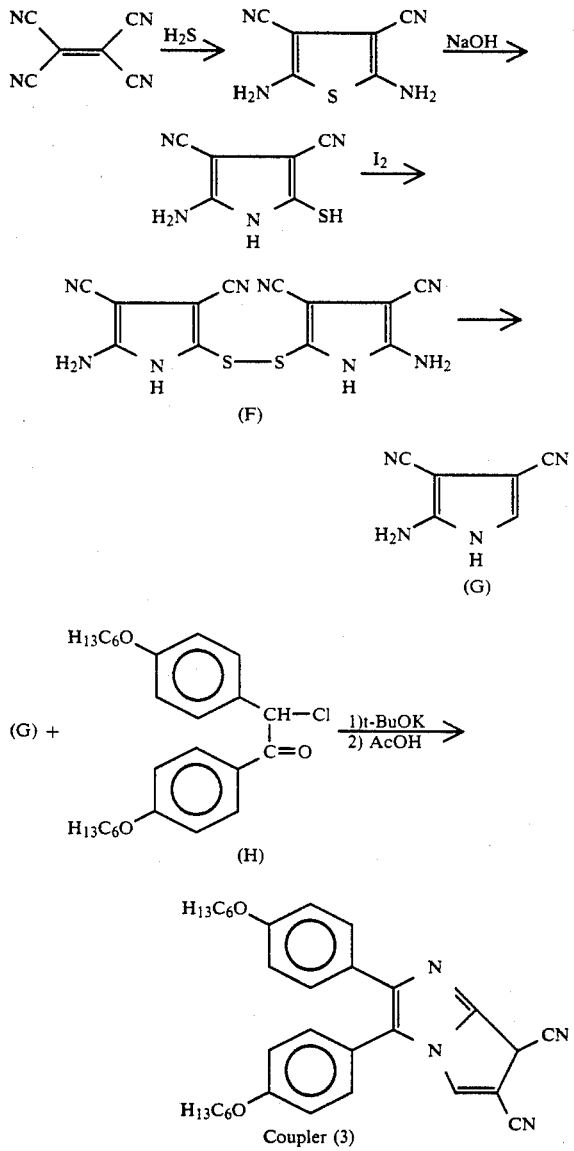

In accordance with the process described in *J. Am. Chem. Soc.*, 80, 2822, Compound (F) was produced from tetracyanoethylene.

16.3 g of Compound (F) was dissolved in 400 ml of ethanol, and 40 g of a fresh Raney nickel was added thereto and heated under reflux for 2 hours.

The reaction mixture was filtered while hot, and the residue was washed with 200 ml of a hot ethanol. The solvent was removed from the filtrate by distillation under reduced pressure to obtain 12.5 g of 2-amino-3,4-dicyanopyrrole (G).

21.6 g of Compound (H) obtained by reaction of 4,4-dihexyloxybenzoin and thionyl chloride and 6.6 g of Compound (G) were dissolved in 100 ml of dimethylsulfoxide, and 6.1 g of potassium t-butoxide was added thereto little by little at room temperature. The whole was stirred at 50° C. for 2 hours and then left to cool to room temperature, and the reaction mixture then was poured into a cold diluted hydrochloric acid, which was then extracted with ethyl acetate. The extract was washed with water and dried, and ethyl acetate was removed by distillation. 100 ml of acetic acid was added to the residue, which was then heated at 80° C. for 5 hours. The reaction mixture was poured into an ice-water and then extracted with ethyl acetate. After washing with water and drying, ethyl acetate was removed by distillation. The resulting residue was purified by silica gel chromatography (with an eluent of n-hexane/ethyl acetate of 1/1 by volume) to obtain 11.8 g of Compound (3) of the present invention.

The other compounds of the present invention can be produced by either of the above-mentioned two production routes. The split-off group may be introduced into the couplers of formula (I) by a method of reaction with an appropriate halide compound or by methods described in U.S. Pat. Nos. 3,926,631, 3,419,391, 3,725,067, 3,227,554, and JP-A-57-70817, and JP-B-56-45135 and 57-36577. (The term "JP-B" as used herein means an "examined Japanese patent publication".)

The dyes obtained by oxidative coupling of Couplers (1) and (3) of the present invention and 2-methyl-4-(N-ethyl-N-methanesulfonylethylamino)aniline had a $\sigma$max value of 620 and 642 nm, respectively, in ethyl acetate and showed an absorption characteristic with a sharp toe in a short-wave range.

Cyan dyes forming couplers of formula (I) of the present invention can be incorporated into silver halide color photographic materials as so-called coupler-in-emulsion type couplers; or alternatively, they may also be incorporated into color developers as so-called coupler-in-developer type couplers. The former type of incorporating cyan coupler of formula (I) of the present invention into photographic materials is preferred, in view of the stability of the quality of the materials to be processed and of the simplicity and rapid processability of the materials.

One example of a reaction scheme of using a p-phenylenediamine developing agent is mentioned below.

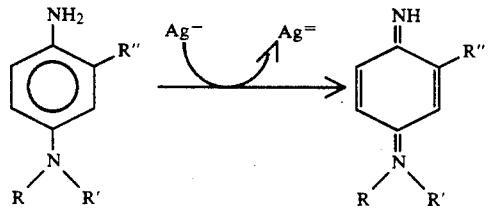

-continued

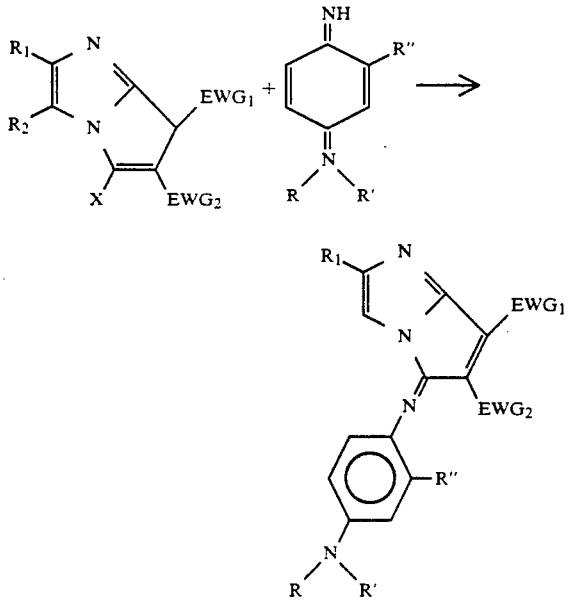

(R, R′ and R″ each represent a hydrogen atom or a substituent.)

Where a coupler of formula (I) of the present invention is incorporated into a silver halide photographic material, at least one layer containing a coupler of formula (I) may be provided on a support. The layer of containing a coupler of formula (I) may be a hydrophilic colloid layer on a support. An ordinary color photographic material may have at least one blue-sensitive silver halide emulsion layer, at least one green-sensitive silver halide emulsion layer and at least one red-sensitive silver halide emulsion layer in this order on a support, but the order of the layer constitution may be different from it. If desired, an infrared-sensitive silver halide emulsion layer may be substituted for at least one of the above light-sensitive emulsion layers. Each of the light-sensitive emulsion layers may contain a silver halide emulsion having a sensitivity to a light of the corresponding wavelength range and a color coupler for forming a dye which is complementary to the light to which the emulsion is sensitive, whereby color reproduction by a subtractive color photographic process is possible in the respective emulsion layers. However, the relationship between the light-sensitive emulsion layer and the color hue of the dye to be formed from the color coupler present therein is not limited to only the above-mentioned constitution.

The coupler of formula (I) of the present invention is especially preferably incorporated into a red-sensitive silver halide emulsion layer in preparing a color photographic material.

The amount of the coupler of formula (I) to be in a photographic material is preferably from $1\times10^{-3}$ mol to 1 mol, more preferably from $2\times10^{-3}$ mol per mol of silver halide to $3\times10^{-1}$ mol.

Where the coupler of formula (I) of the present invention is soluble in an alkaline aqueous solution, it may be dissolved in an alkaline aqueous solution along with a developing agent and other additives and can be used for coupler-in-developer development in forming a color image. In this case, the amount of the coupler to be added may be from 0.0005 to 0.05 mol, preferably from 0.005 to 0.02 mol, per liter of color developer.

The coupler of formula (I) of the present invention can be incorporated into a photographic material by various known dispersion methods. As one preferred example, there is mentioned an oil-in-water dispersion method where a coupler of formula (I) is dissolved in a high boiling point organic solvent (if necessary, along with a low boiling point organic solvent), the resulting solution is dispersed in an aqueous gelatin solution by emulsification and the dispersion is added to a silver halide emulsion.

Examples of high boiling point organic solvents usable in such an oil-in-water dispersion method are described in U.S. Pat. No. 2,322,027.

A latex despersion method is another method for incoporating a coupler of formula (I) into a photographic material. Details and specific examples of a step of dispersing a latex, as one example of a polymer dispersion method, and the effect of such a dispersion method, as well as examples of a latex usable for impregnation in the method are described in U.S. Pat. No. 4,199,363, German Patent OLS Nos. 2,541,274 and 2,541,230, JP-B-53-41091 and European Patent Laid-Open No. 029104. The details of a dispersion method with an organic solvent-soluble polymer are described in PCT W088/00723.

As examples of high boiling point organic solvents usable in the above-mentioned oil-in-water dispersion method, there are mentioned phthalates (e.g., dibutyl phthalate, dioctyl phthalate, dicyclohexyl phthalate, di-2-ethylhexyl phthalate, decyl phthalate, bis(2,4-di-tert-amylphenyl) isophthalate, bis(1,1-diethylpropyl) phthalate), phosphates and phosphonates (e.g., diphenyl phosphate, triphenyl phosphate, tricresyl phosphate, 2-ethylhexyl-diphenyl phosphate, dioctylbutyl phosphate, tricyclohexyl phosphate, tri-2-ethylhexyl phosphate, tridodecyl phosphate, di-2-ethylhexylphenyl phosphonate), benzoates (e.g., 2-ethylhexyl benzoate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having a chlorine content of from 10% to 80%), trimesates (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, 4-(4-dodecyloxyphenylsulfonyl)phenol), carboxylic acids (e.g., 2-(2,4-di-tert-amylphenoxybutyric acid, 2-ethoxyoctandedecanoic acid), and alkyl phosphates (e.g., di-(2-ethylhexyl) phosphate, diphenyl phosphate). As an auxiliary solvent, if desired, an organic solvent having a boiling point of from about 30° C. to about 160° C. can be used. Examples of such an auxiliary solvent are ethyl acetate, butyl acetate, ethyl propionate, methyl ethyl ketone, cyclohexanone, 2-ethoxyethyl acetate, and dimethylformamide.

Above all, so-called polar high boiling point organic solvents are preferably used with the couplers of the present invention. As examples of high boiling point organic solvent amides which can be used with the couplers of the present invention, in addition to the above-mentioned ones, those described in U.S. Pat.

Nos. 2,322,027, 4,127,413 and 4,745,049 are referred to. Above all, high boiling point organic solvents having a specific inductive capacity (as measured at 25° C. and 10 Hz) of about 6.5 or more, preferably from 5 to 6.5 are preferred.

The high boiling point organic solvent is used in an amount of from 0 to 2.0 times by weight, preferably from 0 to 1.0 time by weight, to the coupler.

The couplers of formula (I) of the present invention can be applied to, for example, color papers, color reversal papers, direct positive color photographic materials, color negative films, color positive films, and color reversal films. In particular, application to color photographic materials having a reflective support (for example, color papers or color reversal papers) is preferred.

The silver halide emulsion to be used in the present invention may have any halogen composition of silver iodobromide, silver iodochlorobromide, silver bromide, silver chlorobromide or silver chloride.

The preferred halogen composition varies, depending upon the kind of the photographic material to which the coupler of the invention is applied. For a color paper, a silver chlorobromide emulsion is preferred. For a picture-taking photographic material such as a color negative film or color reversal film, a silver iodobromide emulsion having a silver iodide content of from 0.5 to 30 mol % (preferably, from 2 to 25 mol %) is preferred. For a direct positive color photographic material, a silver bromide or silver chlorobromide emulsion is preferred. For a color paper photographic material for rapid processing, a so-called high silver chloride emulsion having a high silver chloride content is preferred. The silver chloride content in such as high silver chloride emulsion is preferably 90 mol % or more, more preferably 95 mol % or more.

In such a high silver chloride emulsion, it is preferred that a silver bromide localized phase is in the inside and/or surface of the silver halide grain in the form of a layered or non-layered structure. The halogen composition in the localized phase is preferably such that the silver bromide content therein is at least 10 mol % or more, more preferably more than 20 mol %. The localized phase may be in the inside of the grain or on the edges, corners or planes of the surface of the grain. As one preferred embodiment, the localized phase may be grown epitaxially on the corners of the grain.

In the present invention, a silver chlorobromide or silver chloride which does not substantially contain silver iodide is preferably used. The term "does not substantially contain silver iodide" as referred to herein means that the silver iodide content in the silver halide is 1 mol % or less, preferably 0.2 mol % or less.

The halogen composition of the grains in the emulsion for use in the present invention may differ from grain to grain. Preferably, however, the emulsion contains grains each having the same halogen composition, as the property of the grains may easily be homogenized. The halogen composition distribution of the grains in the silver halide emulsion for use in the present invention may be a so-called uniform halogen composition structure where any part of the grain has the same halogen composition; or the grain may have a so-called laminate structure where the halogen composition of the core of the inside of the grain is different from that of the shell (which may be one layer or plural layers) surrounding the core; or the grain may have a composite halogen composition structure where the inside or surface of the grain has a non-layered different halogen composition part (for example, when such a non-layered different halogen composition parts are on the surface of the grain, it may be on the edge, corner or plane of the grain as a conjugated structure). Any of such halogen compositions may properly be selected. In order to obtain a high sensitivity photographic material, the laminate or composite halogen composition structure grains are advantageously employed, rather than uniform halogen composition structure grains. Such laminate or composite halogen composition structure grains are also preferred for preventing generation of pressure marks. In the case of laminate or composite halogen composition structure grains, the boundary between the different halogen composition parts may be a definite one or may also be an indefinite one as the result of formation of a mixed crystal structure of the different halogen compositions. If desired, the boundary between them may have a positive continuous structural change.

The silver halide grains constituting the silver halide emulsion used in the present invention may have an average grain size of preferably from 0.1 μm to 2 μm, especially preferably from 0.15 μm to 1.5 μm. (The grain size indicates a diameter of a circle having an area equivalent to the projected area of the grain, and the average grain size indicates a number average value to be obtained from the measured grain sizes.) The grain size distribution of the emulsion is preferably that of a so-called monodispersed emulsion having a fluctuation coefficient (to be obtained by dividing the standard deviation of the grain size distribution by the mean grain size) of 20% or less, preferably 15% or less. For the purpose of obtaining a broad latitude, two or more monodispersed emulsions may be blended to form a mixed emulsion in one layer, or two or more monodispersed emulsions may be separately coated in different layers to form plural layers. Such blending or separate coating is preferably effected for the purpose.

The form of the silver halide grains constituting the silver halide emulsion of the present invention may be a regular crystalline form such as a cubic, tetradecahedral or octahedral crystalline form, or an irregular crystalline form such as spherical or tabular crystalline forms, or may be composite crystalline forms composed them. The grains may also be tabular grains.

The silver halide emulsion for use in the present invention may be either a so-called surface latent image type emulsion for forming a latent image essentially on the surface of the grain or a so-called internal latent image type emulsion for forming a latent image essentially in the inside of the grain.

The silver halide photographic emulsion for use in the present invention can be produced by various known methods, for example, by the methods described in *Research Disclosure* (RD) No. 17643 (December, 1978), pages 22 to 23, "I. Emulsion Preparation and Types", ibid., No. 18716 (November, 1979), page 648; P. Glafkides, *Chemie et Phisique Photographique* (published by Paul Montel, 1967); F. Duffin, *Photographic Emulsion Chemistry* (published by Focal Press, 1966); and V. L. Zelikman et al., *Making and Coating Photographic Emulsion* (published by Focal Press, 1964).

Monodispersed emulsions as prepared by the methods described in U.S. Pat. Nos. 3,574,628 and 3,655,394 and British Pat. No. 1,413,748 are also preferably employed in the present invention.

Tabular grains having an aspect ratio of about 5 or more may also be employed in the present invention. Such tabular grains may easily be prepared by known methods, for example, by the methods described in Gutoff, *Photographic Science and Engineering*, Vol. 14, pages 248 to 257 (1970); and U.S. Pat. Nos. 4,434,226, 4,414,310, 4,433,048 and 4,439,520 and British Pat. No. 2,112,157.

The crystal structure of the silver halide grains for use in the present invention may be a structure in which different halogen compositions are present in the inside of the grain and the surface part thereof, or may be a layered structure. The silver halide grains may be composed of different silver halide compositions bonded by epitaxial junction. If desired, the silver halide grains may be joined with compounds other than silver halides, such as silver rhodanide or lead oxide.

A mixture comprising silver halide grains having different crystalline forms may also be used.

The silver halide emulsion for use in the present invention may generally be physically ripened, chemically ripened or spectrally sensitized.

Various polyvalent metal ion impurities may be introduced into the silver halide grains for use in the present invention, during the step of forming the grains or the step of physically ripening them. As examples of compounds, there are mentioned salts of cadmium, zinc, lead, copper or thallium, as well as salts or complex salts of VIII Group elements (in the Periodic Table) of iron, ruthenium, rhodium, palladium, osmium, iridium or platinum.

Additives usable in physical ripening, chemical ripening and spectral sensitizing steps applicable to the silver halide emulsions for use in the present invention are described in *Research Disclosure* Nos. 17643, 18716 and 307105, and the relevant parts therein are mentioned below. Other known additives which may be used in the present invention are also described in these *Research Disclosure*, and the relevant parts therein are also mentioned below.

| Kind of Additives | RD 17543 | RD 18716 | RD 307105 |
|---|---|---|---|
| 1. Chemical Sensitizers | p. 23 | p. 648, right column | p. 866 |
| 2. Sensitivity Enhancers | | p. 648, right column | |
| 3. Spectral Sensitizers, Supersensitizers | pp. 23 to 24 | p. 648, right column to p. 649, right column | pp. 866 to 868 |
| 4. Whitening Agents | p. 24 | p. 647, right column | p. 868 |
| 5. Anti-foggants, Stabilizers | pp. 24 to 25 | p. 649, right column | pp. 868 to 870 |
| 6. Light-Absorbents, Filter Dyes, Ultraviolet Absorbent | pp. 25 to 26 | p. 649, right column to p. 650, left column | p. 873 |
| 7. Stain Inhibitors | p. 25, right column | p. 650, left to right column | p. 872 |
| 8. Color Image Stabilizers | p. 25 | p. 650, left column | p. 872 |
| 9. Hardening Agents | p. 26 | p. 651, left column | pp. 874 to 875 |
| 10. Binders | p. 26 | p. 651, left column | pp. 873 to 874 |
| 11. Plasticizers, Lubricants | p. 27 | p. 650, right column | p. 876 |
| 12. Coating Aids Surfactants | pp. 26 to 27 | p. 650, right column | pp. 875 to 876 |
| 13. Antistatic Agents | p. 27 | p. 650, right column | pp. 876 to 877 |
| 14. Mat Agents | | | pp. 878 to 879 |

In order to prevent deterioration of the photographic property of the photographic material of the invention by formaldehyde gas, compounds capable of reacting with formaldehyde so as to fix it, for example, those described in U.S. Pat. Nos. 4,411,987 and 4,435,503, are preferably incorporated into the material.

Various color couplers can be incorporated into the photographic material of the present invention, and examples of usable color couplers are described in patent publications as referred to in the above-mentioned *RD* No. 17643, Item VII-C to G and *RD* No. 307105, Item VII-C to G.

As yellow couplers, for example, those described in U.S. Pat. Nos. 3,933,501, 4,022,620, 4,326,024, 4,401,752, 4,248,961, JP-B-58-10739, British Pat. Nos. 1,425,020, 1,476,760, U.S. Pat. Nos. 3,973,968, 4,314,023, 4,511,649, and European Pat. No. 249,473A are preferred.

It is preferred that yellow couplers which have a maximum absorption wavelength in a short-wave range and have a sharply decreasing absorption in a long-wave range exceeding 500 nm are combined with the couplers of formula (I) of the present invention, in view of the color reproducibility of the combined couplers. Such yellow couplers are described in, for example, JP-A-63-123047 and 1-173499.

As magenta couplers, 5-pyrazolone compounds and pyrazoloazole compounds are preferred. For instance, those described in U.S. Pat. Nos. 4,310,619, 4,351,897, European Pat. No. 73,636, U.S. Pat. Nos. 3,061,432, 3,725,067, *RD* No. 24220 (June, 1984), JP-A-60-33552, *RD* No. 24230 (June, 1984), JP-A-60-43659, 61-72238, 60-35730, 55-118034, 60-185951, U.S. Pat. Nos. 4,500,630, 4,540,654, 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,233, 4,296,200, 2,369,929, 2,801,171, 2,771,162, 2,895,826, 3,772,002, 3,758,308, 4,334,011, 4,327,173, West German Pat. (OLS) No. 3,329,729, European Pat. Nos. 121,365A, 249,453A, U.S. Pat. Nos. 3,446,622, 4,333,999, 4,775,616, 4,451,559, 4,427,767, 4,690,889, 4,254,212, 4,296,199, and JP-A-61-42658 are preferred.

Colored couplers for correcting the unwanted absorption of colored dyes may also be used in the present invention. As such colored couplers, those described in *RD* No. 17643, Item VII-G, U.S. Pat. No. 4,163,670, JP-B-57-39413, U.S. Pat. Nos. 4,004,929, 4,138,258, and British Pat. No. 1,146,368 are preferred. Additionally, couplers for correcting the unwanted absorption of a colored dye by a fluorescent dye which is released during coupling, as described in U.S. Pat. No. 4,774,181, as well as couplers having a dye precursor group capable of reacting with a developing agent to form a dyes, as a split-off group, as described in U.S. Pat. No. 4,777,120 are also preferably used.

Couplers capable of forming colored dyes having a suitable degree of pertinent diffusibility may also be used, and those described in U.S. Pat. No. 4,366,237, British Pat. No. 2,125,570, European Pat. No. 96,570, and West German Pat. (OLS) No. 3,234,533 are preferred.

Polymerized dye-forming couplers may also be used, and typical examples of such couplers are described in U.S. Pat. Nos. 3,451,820, 4,080,211, 4,367,282, 4,409,320, 4,576,910, and British Pat. No. 2,102,173.

Couplers capable of releasing a photographically useful residue on coupling may also be used in the present invention. For instance, DIR couplers which release a development inhibitor are described in the patent publications referred to in the above-mentioned *RD* No. 17643, Item VII-F, and are described in JP-A-57-151944, 57-154234, 60-184248 and 63-37346, and U.S. Pat. Nos. 4,248,962 and 4,782,012 are preferred.

Couplers for imagewise releasing a nucleating agent or development accelerator during development are described in British Pat. Nos. 2,097,140 and 2,131,188, and JP-A-59-157638 and 59-170840 are preferred.

Additionally, as examples of other couplers which may be incorporated into the photographic materials of the present invention, there are further mentioned competing couplers described in U.S. Pat. No. 4,130,427; poly-valent couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and 62-24252; couplers for releasing a dye which recolors after being released from the coupler, as described in European Pat. No. 173,302A; bleaching accelerator-releasing couplers as described in RD Nos. 11449 and 24241, and JP-A-61-201247; ligand-releasing couplers described in U.S. Pat. No. 4,553,477; leuco dye-releasing couplers described in JP-A-63-75747; and couplers which release a fluorescent dye as described in U.S. Pat. No. 4,774,181.

The standard amount of couplers which may be used together with the coupler of formula (I) of the present invention is from 0.001 to 1 mol per mol of silver halide. Preferably, it is from 0.01 to 0.5 mol for yellow couplers; from 0.003 to 0.3 mol for magenta couplers. Cyan couplers are used in an amount such as that the effects of the present invention are not hindered. The amount is preferably within the range of from 0.002 to 0.3 mol.

Such couplers may be incorporated into the photographic material of the present invention by various known dispersion methods mentioned above.

The photographic material of the present invention may further contain hydroquinone derivatives, aminophenol derivatives, gallic acid derivatives and ascorbic acid derivatives, as a color fogging inhibitor.

The photographic material of the present invention may also contain various anti-fading agents. As typical organic anti-fading agents for cyan, magenta and/or yellow images usable in the present invention, there are mentioned hindered phenols such as hydroquinones, 6-hydroxychromans, 5-hydroxycoumarans, spirochromans, p-alkoxyphenols and bisphenols, and gallic acid derivatives, methylenedioxybenzenes, aminophenols, hindered amines and ether or ester derivatives formed by silylating or alkylating the phenolic hydroxyl group of the compounds. In addition, metal complexes such as (bissalicylaldoximato)nickel complexes and (bis-N,N-dialkyldithiocarbamato)nickel complexes may also be used.

As specific examples of organic anti-fading agents usable in the present invention, there are mentioned hydroquinones described in U.S. Pat. Nos. 2,360,290, 2,418,613, 2,700,453, 2,701,197, 2,728,659, 2,732,300, 2,735,765, 3,982,944 and 4,430,425, British Pat. No. 1,363,921, U.S. Pat. Nos. 2,710,801 and 2,816,028; 6-hydroxychromans, 5-hydroxychromans and spirochromans described in U.S. Pat. Nos. 3,432,300, 3,573,050, 3,574,627 3,698,909 and 3,764,337, and JP-A-52-152225; spiroindanes described in U.S. Pat. No. 4,360,589; p-alkoxyphenols described in U.S. Pat. No. 2,735,765, British Pat. No. 2,066,975, JP-A-59-10539, and JP-B-57-19765; hindered phenols described in U.S. Pat. Nos. 3,700,455 and 4,228,235, JP-A-52-72224, and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Pat. Nos. 1,326,889, 1,354,313 and 1,410,846, JP-B-51-1420, and JP-A-58-114036, 59-53846 and 59-78344; and metal complexes described in U.S. Pat. Nos. 4,050,938 and 4,241,155, and British Pat. No. 2,027,731(A). The compounds are incorporated into the light-sensitive layers by co-emulsifying them with the corresponding color couplers generally in an amount of from 5 to 100% by weight with respect to couler.

For the purpose of preventing cyan color images from fading by heat and especially by light, incorporation of an ultraviolet absorbent into the cyan coloring layer and the both adjacent layers is effective.

As examples of ultraviolet absorbents usable for this purpose, there are mentioned aryl group-substituted benzotriazole compounds (for example, those described in U.S. Pat. No. 3,533,794), 4-thiazolidones (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070 and 4,271,307). Ultraviolet absorbing couplers (for example, α-naphthol cyan dye forming couplers) and ultraviolet absorbing polymers may also be used. Such ultraviolet absorbents may be mordanted in particular layers.

From among these compounds, aryl group-substituted benzotriazole compounds are preferred.

Gelatin is advantageously used as a binder or protective colloid in the emulsion layers constituting the photographic material of the present invention. Any other hydrophilic colloid may also be used singly or along with gelatin.

Gelatin for use in the present invention may be either a lime-processed one or an acid-processed one. The details of producing gelatin are described in Arther Vais, *The Macromolecular Chemistry of Gelatin* (published by Academic Press, 1964).

The photographic material of the present invention can contain various antiseptics and fungicides, such as 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, as described in JP-A-63-257747, 62-272248 and 1-80941.

Where the photographic material of the present invention is a direct positive color photographic material, it may contain a nucleating agent, such as hydrazine compounds or quaternary heterocyclic compounds as described in *Research Disclosure* No. 22534 (January, 1983), as well as a nucleation accelerator for promoting the effect of such a nucleating agent.

As the support to be used in the photographic material of the present invention, a transparent film such as cellulose nitrate film or polyethylene terephthalate film, or a reflective support, which is generally used in preparing ordinary photographic materials, can be used. In view of the object of the present invention, a reflective support is more preferred.

A "reflective support" which is advantageously used in the present invention is one capable of elevating the reflectivity of the photographic material to thereby sharpen the color image which is formed in the silver halide emulsion layer. Such a reflective support includes one which is prepared by coating a hydrophobic resin containing a photo-reflecting substance, such as titanium oxide, zinc oxide, calcium carbonate or calcium sulfate, as dispersed therein, on a support base; and one which is formed from a hydrophobic resin which itself contains the above-mentioned photo-reflective substance which is dispersed therein. For instance, there are mentioned baryta paper; polyethylene-coated paper; polypropylene synthetic paper; and a transparent support (such as glass plate, polyester films such as polyethylene terephthalate, cellulose triacetate or cellulose nitrate film, polyamide films, polycarbonate films, polystyrene films, vinyl chloride resin films) which is coated with a reflective layer or containing a reflective substance.

The photographic material of the present invention may be processed in accordance with any ordinary photographic processing methods, for example, by the methods described in the above-mentioned *Research Disclosure* No. 17643, pages 28 to 29 and ibid., No. 18716, page 615, from left to right column. For instance, the material is subjected to color development comprising a color developing step, a desilvering step and a rinsing step. Where the material is subjected to reversal development, the process comprises a black-and-white developing step, a water-washing or rinsing step, a reversal step and a color developing step. In the desilvering step, in place of bleaching with a bleaching solution and fixing with a fixing solution, a combined bleach-fixing with a bleach-fixing solution may also be effected. The bleaching step, fixing step and bleach-fixing step may be combined in any desired order. In place of a water-washing step, stabilization may be effected. If desired, the photographic material may be processed by a mono-bath process of using a mono-bath developing and bleach-fixing solution where color development, bleaching and fixation are effected in one bath. In combination with these processing steps, any one or more processing step selected from a pre-hardening step, a step for neutralization thereof, a stopping and fixing step, a post-hardening step, an adjusting step and an intensifying step may be carried out. Between these steps, any desired intermideiate-water-washing step may be provided. In place of the color development step, a socalled activator processing step may also be effected.

The color developer to be used for developing the photographic material of the present invention is an aqueous alkaline solution containing an aromatic primary amine color developing agent as a main component. As the color developing agent, aminophenol compounds are useful, but p-phenylenediamine compounds are more preferably used. As specific examples of such compounds, there are mentioned 3-methyl-4-amino-N,N-diethylaniline, 3-methyl-4-amino-N-ethyl-N-β-hydroxyethylaniline, 4-amino-N-ehtyl--N-β-hydroxyethylaniline, 3-methyl-4-amino-N-ethyl-N-β-methanesulfonamidoethylaniline, 3-methyl-4-amino-N-ethyl-β-methoxyethylanilne, and sulfates, hydrochlorides and p-toluenesulfonates of the compounds. These compounds may be used singly or in combination of two or more of them, in accordance with the intended purpose.

The color developer generally contains a pH buffer such as alkali metal carbonates, borates or phosphates; and a development inhibitor or an antifoggant such as chlorides, bromides, iodides, benzimidazoles, benzothiazoles or mercapto compounds. If desired, it may also contain various preservatives, such as hydroxylamine, diethylhydroxylamine, sulfites, hydrazines (e.g., N,N-biscarboxymethylhydrazine), phenylsemicarbazides, triethanolamine, and catechol-sulfonic acids; organic solvents such as ethylene glycol or diethylene glycol; development accelerators such as benzyl alcohol, polyethylene glycol, quaternary ammonium salts or amines; dye forming couplers; competing couplers; auxiliary developing agents such as 1-phenyl-3-pyrazolidone; nucleating agents such as sodium boronhydride or hydrazine compounds; tackifiers; various chelating agents such as aminopolycarboxylic acids, aminopolyphosphonic acids, alkylphosphonic acids or phosphonocarboxylic acids (e.g., ethylenediamine-tetraacetic acid, nitrilotriacetic acid, diethylenetriamine-pentaacetic acid, cyclohexanediamine-tetraacetic acid, hydroxyethylimino-diacetic acid, 1-hydroxyethylidene-1,1-diphosphonic acid, nitrilo-N,N,N-trimethylene-phosphonic acid, ethylenediamine-N,N,N,N-tetramethylenephosphonic acid, ethylenediamine-di(o-hydroxyphenylacetic acid) and salts thereof); fluorescent brightening agents such as 4,4'-diamino-2,2'-disulfostilbene compounds; and various surfactants such as alkylsulfonic acids, arylsulfonic acid, aliphatic carboxylic acids and aromatic carboxylic acids.

The color developer for use in the present invention is desired to substantially not contain benzyl alcohol. The color developer substantially not containing benzyl alcohol is one containing benzyl alcohol, preferably in an amount of 2 ml/liter or less, more preferably 0.5 ml/liter or less, most preferably is one containing no benzyl alcohol.

The color developer for use in the present invention is desired to substantially not contain sulfite ion. The color developer substantially not containing sulfite ion is one containing sulfite ion preferably in an amount of $3.0\times10^{-3}$ mol/liter or less, and more preferably is one containing no sulfite ion.

The color developer for use in the present invention is desired to substantially not contain hydroxylamine. The color developer substantially not containing hydroxylamine is one containing hydroxylamine preferably in an amount of $5.0\times10^{-3}$ mol/liter or less, and more preferably is one containing no hydroxylamine. The color developer for use in the present invention desirably contains an organic preservative (for example, hydroxylamine derivatives or hydrazine derivatives), except hydroxylamine.

The color developer generally has a pH value of from 9 to 12.

A color reversal process which can be applied to the photographic material of the present invention generally comprises a black-and-white processing step, a water-washing or rinsing step, a reversal processing step and a color development step. The reversal processing step may use a reversal bath containing a foggant or may be effected by photo-reversal treatment. If desired, such a foggant may be incorporated into a color developer to omit the reversal processing step.

The black-and-white developer to be used in the black-and-white processing step may be any conventional one usable for processing ordinary black-and-white photographic materials, and it may contain any additives generally applicable to ordinary black-and-white developers.

As typical additives, there are mentioned developing agents such as 1-phenyl-3-pyrazolidone, N-methyl-p-aminophenol and hydroquinone; preservatives such as sulfites; pH buffers comprised of water-soluble acids such as acetic acid or boric acid; pH buffers or development accelerators comprised of water-soluble alkaline materials such as sodium hydroxide, sodium carbonate or potassium carbonate; inorganic or organic development inhibitors such as potassium bromide, 2-methylbenzimidazole or methylbenzothiazole; water softeners such as ethylenediaminetetraacetic acid or polyphosphates; antioxidants such as ascorbic acid or diethanolamine; organic solvents such as triethylene glycol or cellosolves; and surface over-development inhibitors such as trace amounts of iodides or mercapto compounds;

Where the amount of replenisher to such a developer is reduced, it is desired that evaporation or aerial oxidation of the processing solution is prevented by reducing the contact area between the surface of the processing tank and air. As a method of reducing the contact area between the surface of the processing tank and air, a surface-shielding material, such as a floating lid, may be provided on the surface of the processing solution in the processing tank. It is preferred that the technique is employed not only in the color development and black-and-white development steps, but also in all the successive steps. In addition, a recovery means for preventing accumulation of bromide ions in the developer tank may also be employed so as to reduce the amount of replenisher to be added to the tank.

The color development time is generally set between 2 minutes and 5 minutes. However, by elevating the processing temperature and elevating the pH value of the processing solution (developer) and further elevating the concentration of the color developing agent in the developer, the processing time may further be shortened.

The photographic emulsion layer is, after being color-developed, desilvered. Desilvering is effected by simultaneous or separate bleaching and fixing. Simultaneous bleaching and fixing is called bleach-fixing. In order to further accelerate the processing, bleach-fixing may be effected after bleaching. If desired, a bleach-fixing bath comprising two tanks which are connected in series may be used; or fixing may be effected before bleach-fixing; or bleach-fixing may be effected after bleaching. The processing systems may be selected and employed in accordance with the intended purpose. In processing the photographic material of the present invention, it is advantageous that the material is color-developed and then immediately bleach-fixed so as to more efficiently attain the effect of the present invention.

As bleaching agents which can be used in the bleaching solution or bleach-fixing solution usable in the present invention, there are mentioned compounds of polyvalent metals such as iron(III); peracids; quinones; and iron salts. Specific examples of such agents are iron chloride; ferricyanides; bichromates; organic complexes of iron(III) (for example, metal complexes of aminopolycarboxylic acids such as ethylenediaminetetraacetic acid, diethylenetriaminepentaacetic acid, 1,3-diaminopropanetetraacetic acid); and persulfates. From among these materials, aminopolycarboxylato/iron(III) complexes are preferred so as to efficiently display the effect of the present invention. Aminopolycarboxylato/iron(III) complexes are useful both in a bleaching solution and especially in a bleach-fixing solution. The bleaching solution or bleach-fixing solution containing such an aminopolycarboxylato/iron(III) complex is used under the condition of a pH of from 3.5 to 8.

The bleaching solution or bleach-fixing solution may contain various known additives, for example, a rehalogenating agent such as ammonium bromide or ammonium chloride; a pH buffer such as ammonium nitrate; and a metal corrosion inhibitor such as ammonium sulfate.

The bleaching solution or bleach-fixing solution preferably contains an organic acid for the purpose of preventing bleaching stains, in addition to the above-mentioned compounds. Especially preferred organic acids for this purpose are compounds having an acid dissociation constant (pKa) of from 2 to 5.5. Specifically, acetic acid and propionic acid are preferred.

As a fixing agent which can be used in the fixing solution or bleach-fixing solution to be used in the present invention, there are mentioned thiosulfates, thiocyanates, thioether compounds, thioureas, and a large amount of iodides. Generally used are thiosulfates. In particular, ammonium thiosulfate is most widely used. In addition, a combination of thiosulfates and thiocyanates, thioether compounds or thioureas is also preferred.

The fixing solution of bleach-fixing solution may contain a preservative such as sulfites, bisulfites, carbonyl-bisulfite adducts, or sulfinic acid compounds described in European Pat. No. 294,769A. In addition, it is preferred to add various amino-polycarboxylic acids or organic phosphonic acids (e.g., 1-hydroxyethylidene-1,1-diphosphonic acid, N,N,N',N'-ethylenediamine-tetraphosphonic acid) to the fixing solution or bleach-fixing solution for the purpose of stabilizing the solution.

The fixing solution or bleach-fixing solution may further contain various fluorescent brightening agents, defoaming agents, surfactants, polyvinyl pyrrolidone and methanol.

The bleaching solution and bleach-fixing solution and the pre-bath thereof may optionally contain a bleaching accelerator. As specific examples of usable bleaching accelerators, there are mentioned compounds having a mercapto group or disulfido group as described in U.S. Pat. No. 3,893,858, German Pat. Nos. 1,290,812 and 2,059,988, JP-A-53-32736, 53-57831, 53-37418, 53-72623, 53-95630, 53-95631, 53-104232, 53-124424, 53-141623 and 53-28426, and *Research Disclosure* No. 17129 (July, 1978); thiazolidine derivatives described in JP-A-50-140129; thiourea derivatives described in JP-B-45-8506, JP-A-52-20832 and 53-32735, and U.S. Pat. No. 3,706,561; iodides described in German Pat. No. 1,127,715, and JP-A-58-16235; polyoxyethylene compounds described in German Pat. Nos. 966,410 and 2,748,430; polyamine compounds described in JP-B-45-8836; compounds described in JP-A-49-42434, 49-59644, 53-94927, 54-35727, 55-26506 and 58-163940;

and bromide ions. Among these compounds, compounds having a mercapto group or disulfido group are preferred as having a large accelerating effect, and in particular, those described in U.S. Pat. No. 3,893,858, German Pat. No. 1,290,812 and JP-A-53-95630 are especially preferred. In addition, compounds described in U.S. Pat. No. 4,552,834 are also preferred. Such a bleaching accelerator may be added to the photographic material. Where the photographic material of the present invention is a picture-taking color photographic material and it is bleach-fixed, the above-mentioned bleaching accelerators are especially effective.

The total desilvering time is desired to be as short as possible within the range where desilvering failure does not occur. The preferred time is from one minute to 3 minutes. The processing temperature may be within the range between 25° C. and 50° C., preferably between 35° C. and 45° C.

In the desilvering step, it is desired that agitation of the system is reinforced as much as possible. As a specific means for accelerating the agitation, there is mentioned a method of forcing a jet stream of the processing solution onto the emulsion-coated surface of the photographic material being processed, as described in JP-A-62-183460. Such an agitation accelerating means is effective in processing steps which use a bleaching solution, a bleach-fixing solution and a fixing solution.

The photographic material of the present invention is generally rinsed with water, after being desilvered as mentioned above. In place of rinsing with water, stabilization may also be effected. In the stabilization step, any known methods as described, for example, in JP-A-57-8543, 58-14834 and 60-220345 may be employed. If desired, a combined rinsing (with water) - stabilization step may be effected, in which a stabilizing bath containing a dye-stabilizing agent and a surfactant is used as the final bath. This combinded step is conveniently applied to picture-taking color photographic materials.

The rinsing solution and stabilizing solution applicable to the photographic material of the present invention may contain a water softener such as inorganic phosphoric acids, polyaminocarboxylic acids or organic aminophosphonic acids; a microbicide such as isothiazolone compounds or thiabendazoles, or a chlorine-containing microbicide such as sodium chloroisocyanurate; a metal salt such as Mg salts, Al salts or Bi salts; a surfactant; a hardening agent; and a bactericide.

The amount of the rinsing water to be used in the rinsing step may be set in a broad range, depending upon the properties of the photographic material being processed (for example, the components of the material, such as couplers, etc.), the use of the material, the temperature of the rinsing water, the number of the rinsing tanks (the number of the rinsing stages), the replenishment system of either countercurrent type or co-current type, and other various conditions. The relationship between the number of the rinsing tanks and the rinsing water in a multi-stage countercurrent rinsing system may be obtained in accordance with the method described in *Journal of the Society of Motion Picture and Television Engineers*, Vol. 64, pages 248 to 253 (May, 1955). The method of reducing the amounts of calcium ions and magnesium ions in the rinsing water, as described in JP-A-62-288838, may be used extremely effectively.

The rinsing water has a pH value of from 4 to 9, preferably from 5 to 8. The temperature of the rinsing water and the rinsing time may also be set variously, depending upon the property and use of the photographic material being processed. In general, the rinsing temperature is from 15° C. to 45° C. and the rinsing time is from 20 seconds to 10 minutes; preferably, the former is from 25° C. to 40° C. and the latter is from 30 seconds to 5 minutes.

As the dye stabilizing agent which may be in the stabilizing solution, there are mentioned aldehydes such as formalin and glutaraldehyde; N-methylol compounds such as dimethylolurea; hexamethylenetetramine; and aldehydesulfite adducts. The stabilizer may further contain a pH adjusting buffer such as boric acid or sodium hydroxide; a chelating agent such as 1 hydroxyethylidene-1,1-diphosphonic acid or ethylenediaminetetraacetic acid; an anti-sulfiding such as alkanolamines; a fluorescent brightening agent; and a fungicide.

The overflow liquid to be derived by replenishment to the above-mentioned rinsing solution and/or the stabilizing solution may be re-circulated to the other baths, such as the previous desilvering bath.

The photographic material of the present invention can contain a color developing agent for the purpose of simply and rapidly processing the material. Preferably, various precursors of color developing materials are incorporated into the material. For instance, as examples of usable precursors, there are mentioned indoaniline compounds described in U.S. Pat. No. 3,342,597, Schiff base compounds described in U.S. Pat. No. 3,342,599, *Research Disclosure* No. 14850 and ibid., No. 15159, aldole compounds described in *Research Disclosure* No. 13924, metal complexes described in U.S. Pat. No. 3,719,492, and urethane compounds described in JP-A-53-135628.

The photographic material of the present invention may contain, if desired, various 1-phenyl-3-pyrazolidones for the purpose of promoting the color developability thereof. Specific examples of compounds usable for the purpose are described in JP-A-56-64339, 57-144547 and 58-115438.

In processing the photographic material of the present invention, the processing solutions are used at a temperature between 10° C. and 50° C. In general, the standard processing temperature is between 33° C. and 38° C. The processing temperature may be elevated higher so as to promote the processing step or to shorten the processing time or it may be lowered so as to improve the image quality of the image to be formed or to promote the stability of the processing solutions being used.

The present invention will be explained in more detail by way of the following examples, which, however, are not intended to restrict the scope of the present invention.

EXAMPLE 1

Preparation of Sample No. 101

Two layers mentioned below were formed on a cellulose triacetate film support to prepare a photographic material sample which is designated as Sample No. 101. A coating composition for the first layer was prepared as mentioned below.

Preparation of Coating Composition for First Layer 1.01 g of cyan coupler (A-1) and 0.62 g of dibutyl phthalate were completely dissolved in 10.0 cc of ethyl acetate. The coupler containing ethyl acetate solution was added to 42 g of an aqueous 10% gelatin solution (containing 7 g/liter of sodium dodecylbenzenesulfonate) and dispersed by emulsification with a homogenizer. After dispersion and emulsification, distilled water was added to the resulting dispersion to make the whole to be 100 g. 100 g of the dispersion and 8.2 g of a high silver chloride emulsion (AgBrCl emulsion having a silver bromide content of 0.5 mol %) were blended to prepare a coating composition for the first layer, which contained the components mentioned below. As a gelatin hardening agent used was 1-hydroxy-3,5-dichloro-s-triazine sodium salt.

Layer Constitution

The layers contained the components mentioned below.

Support

Cellulose Triacetate Film

| | |
|---|---|
| First Layer (Emulsion Layer): | |
| Silver Halide in High Silver Chloride Emulsion | 0.29 g/m$^2$ as Ag |
| Gelatin | 2.60 g/m$^2$ |
| Cyan Coupler (A-1) | 0.49 g/m$^2$ |
| Dibutyl Phthalate | 0.30 g/m$^2$ |
| Second Layer (Protective Layer): | |
| Gelatin | 1.90 g/m$^2$ |

Preparation of Samples Nos. 102 to 107

Samples Nos. 102 to 107 were prepared in the same manner as above, except that the cyan coupler (A-1) in Sample No. 101 was replaced by the same molar amount of the coupler as indicated in Table 1 below.

Cyan Coupler (A-1):

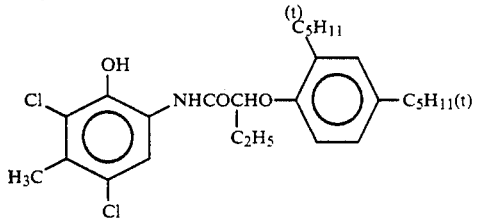

Samples Nos. 101 to 107 thus prepared were wedgewise exposed with a white light and then processed in accordance with the process mentioned below.

The processed samples were evaluated with respect to the color hue and the heat-fastness of the image formed.

Evaluation of Color Hue

The spectral absorption of the maximum density part of the processed sample was measured. The side absorption and the sharpness of the toe in the short-wave side were obtained in accordance with the following formulae. From the values obtained, the color hue of the processed sample was evaluated. For both values, the smaller, the better.

Side Absorption
= (Absorption density at 420 nm)/(Absorption density at the maximum absorption wavelength)
Sharpness of Toe in Short-wave Side
= (Absorption density at 550 nm)/(Absorption density at the maximum absorption wavelength)

Evaluation of Heat-Fastness

The processed samples were subjected to a fading test by storing them at 80° C. for 2 weeks, whereupon the cyan density (DR) at the part having a cyan density of 1.0 before the test was measured. A color retention percentage was obtained from the following formula, and the heat-fastness of each sample was determined on the basis of the color retention value obtained. The larger the color retention percentage the better.

$$\text{Color Retention Percentage} = \{(D_R)/1.0\} \times 100$$

Results thus obtained are shown in Table 1.

| Processing Step | Temperature | Time |
|---|---|---|
| Color Development | 38° C. | 45 sec |
| Bleach-fixing | 35° C. | 45 sec |
| Rinsing (1) | 35° C. | 30 sec |
| Rinsing (2) | 35° C. | 30 sec |
| Rinsing (3) | 35° C. | 30 sec |
| Drying | 80° C. | 60 sec |

(Rinsing was effected by 3-tank countercurrent system from (3) to (1).)

The processing solutions used had the following compositions.

| | |
|---|---|
| Color Developer: | |
| Water | 800 ml |
| Ethylenediamine-N,N,N,N-tetramethylenephosphonic Acid | 3.0 g |
| Triethanolamine | 8.0 g |
| Potassium Chloride | 3.1 g |
| Potassium Bromide | 0.015 g |
| Potassium Carbonate | 25 g |
| Hydrazinodiacetic Acid | 5.0 g |
| N-ethyl-N-(β-methanesulfonamidoethyl)-3-methyl-4-minoaniline Sulfate | 5.0 g |
| Fluorescent Brightening Agent (WHITEX-4, product by Sumitomo) | 2.0 g |
| Water to make | 1000 ml |
| pH (with potassium hydroxide) | 10.05 |
| Bleach-fixing Solution: | |
| Water | 400 ml |
| Ammonium Thiosulfate Solution (700 g/liter) | 100 ml |
| Ammonium Sulfite | 45 g |
| Ammonium Ethylenediaminetetraacetato/Iron(III) | 55 g |
| Ethylenediaminetetraacetic Acid | 3 g |
| Ammonium Bromide | 30 g |
| Nitric Acid (67%) | 27 g |
| Water to make | 1000 ml |
| pH | 6.2 |

Rinsing Solution

Ion-exchanged Water (having calcium and magnesium contents of each 3 ppm or less).

TABLE 1

| Sample No. | Coupler | Side Absorption | Sharpness of Toe in Short-wave Side | Heat-Fastness | Remarks |
|---|---|---|---|---|---|
| 101 | A-1 | 0.178 | 0.228 | 74% | Comparative |

TABLE 1-continued

| Sample No. | Coupler | Side Absorption | Sharpness of Toe in Short-wave Side | Heat-Fastness | Remarks |
|---|---|---|---|---|---|
| | | | | | Sample |
| 102 | Coupler (2) | 0.077 | 0.182 | 92 | Sample of the Invention |
| 103 | Coupler (3) | 0.071 | 0.175 | 96 | Sample of the Invention |
| 104 | Coupler (9) | 0.075 | 0.181 | 90 | Sample of the Invention |
| 105 | Coupler (12) | 0.076 | 0.180 | 91 | Sample of the Invention |
| 106 | Coupler (13) | 0.074 | 0.181 | 92 | Sample of the Invention |
| 107 | Coupler (15) | 0.074 | 0.180 | 91 | Sample of the Invention |

As is obvious from the results in Table 1 above, the couplers of the present invention form dyes having a small side absorption and having a sharp toe in the shortwave side, and the dyes from the couplers had a high heat-fastness.

EXAMPLE 2

Samples Nos. 201 to 207 were prepared in the same manner as in Example 1, except that a silver iodobromide emulsion (having a silver iodide content of 8.0 mol %) was used in place of the high silver chloride emulsion in Samples Nos. 101 to 107, respectively. The samples thus prepared were processed in accordance with the process mentioned below, and they were evaluated in the same manner as in Example 1.

The results obtained are shown in Table 2 below.

| Photographic Processing Method | | |
|---|---|---|
| Processing Step | Time | Temperature |
| Color Development | 3 min 15 sec | 38° C. |
| Bleaching | 1 min 00 sec | 38° C. |
| Bleach-Fixing | 3 min 15 sec | 38° C. |
| Rinsing (1) | 0 min 40 sec | 35° C. |
| Rinsing (2) | 1 min 00 sec | 35° C. |
| Stabilization | 0 min 40 sec | 38° C. |
| Drying | 1 min 15 sec | 55° C. |

The processing solutions used above had the following compositions.

| | |
|---|---|
| Color Developer: | |
| Diethylenetriaminepentaacetric Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-[N-ethyl-N-β-hydroxyethylamino]-2-methylaniline Sulfate | 4.5 g |
| Water to make | 1.0 liter |
| pH | 10.05 |
| Bleaching Solution: | |
| Ammonium Ethylenediaminetetra-acetato/Iron(III) Dihydrate | 120.0 g |
| Disodium Ethylenediaminetetraacetate | 10.0 g |
| Ammonium Bromide | 100.0 g |
| Ammonium Nitrate | 10.0 g |
| Bleaching Accelerator | 0.005 mol |

-continued

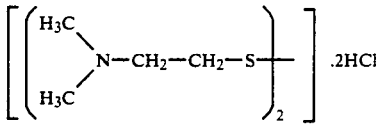

| | |
|---|---|
| Aqueous Ammonia (27%) | 15.0 ml |
| Water to make | 1.0 liter |
| pH | 6.3 |
| Bleach-fixing Solution: | |
| Ammonium Ethylenediaminetetra-acetato/Iron(III) Dihydrate | 50.0 g |
| Disodium Ethylenediaminetetraacetate | 5.0 g |
| Sodium Sulfite | 12.0 g |
| Aqueous Ammonium Thiosulfate Solution (70%) | 240.0 ml |
| Aqueous Ammonia (27%) | 6.0 ml |
| Water to make | 1.0 liter |
| pH | 7.2 |

Rinsing Solution

A city water was passed through a mixed bed type column filled with an H-type strong acidic cation-exchange resin (Amberlite IR-120B, produced by Rohm & Haas Co.) and an OH-type strong basic anion-exchange resin (Amberlite IRA-400, produced by Rohm & Haas Co.) so that both the calcium ion concentration and the magnesium ion concentration in the water were reduced to not more than 3 mg/liter, individually. Next, 20 mg/liter of sodium dichloroisocyanurate and 0.15 g/liter of sodium sulfate were added to the resulting water, which had a pH falling of from 6.5 to 7.5. This was used as the rinsing water.

| Stabilizing Solution: | |
|---|---|
| Formalin | 2.0 ml |
| Polyoxyethylene-p-monononylphenyl Ether (average polymerization degree 10) | 0.3 g |
| Disodium Ethylenediaminetetraacetate | 0.05 g |
| Water to make | 1.0 liter |
| pH | 5.0 to 8.0 |

TABLE 2

| Sample No. | Coupler | Side Absorption | Sharpness of Toe in Short-wave Side | Remarks |
|---|---|---|---|---|
| 201 | A-1 | 0.177 | 0.218 | Comparative Sample |
| 202 | Coupler (2) | 0.076 | 0.172 | Sample of the Invention |
| 203 | Coupler (3) | 0.071 | 0.164 | Sample of the Invention |
| 204 | Coupler (9) | 0.076 | 0.180 | Sample of the Invention |
| 205 | Coupler (12) | 0.075 | 0.180 | Sample of the Invention |
| 206 | Coupler (13) | 0.074 | 0.179 | Sample of the Invention |
| 207 | Coupler (15) | 0.075 | 0.178 | Sample of the Invention |

As is obvious from the results in Table 2 above, the couplers of the present invention when present in a silver iodobromide photographic material (Samples Nos. 202 to 207) gave dyes having a small side absorption and having a sharp toe in the short-wave side, and the dyes from the couplers had a high heat-fastness.

EXAMPLE 3

The same samples as those in Example 2 were processed in accordance with the process mentioned below, and the processed samples were tested and evaluated in the same manner as in Example 2.

The results obtained are shown in Table 3 below.

| Photographic Processing Method | | |
|---|---|---|
| Step | Time | Temperature |
| First Development | 6 min | 38° C. |
| Rinsing with water | 2 min | 38° C. |
| Reversal | 2 min | 38° C. |
| Color Development | 6 min | 38° C. |
| Adjustment | 2 min | 38° C. |
| Bleaching | 6 min | 38° C. |
| Fixing | 4 min | 38° C. |
| Rinsing with water | 4 min | 38° C. |
| Stabilization | 1 min | room temperature |
| Drying | | |

The processing solutions used above had the following compositions.

| | |
|---|---|
| First Developer: | |
| Water | 700 ml |
| Pentasodium Nitrilo-N,N,N-trimethylenephosphonate | 2 g |
| Sodium Sulfite | 20 g |
| Hydroquinone Monosulfonate | 30 g |
| Sodium Carbonate Monohydrate | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1000 ml |
| pH | 9.60 |
| Reversal Processing Solution: | |
| Water | 700 ml |
| Pentasodium Nitrilo-N,N,N-trimethylenephosphonate | 3 g |
| Stannous Chloride Dihydrate | 1 g |
| P-aminophenol | 0.1 g |
| Sodium Hydroxide | 8 g |
| Glacial Acetic Acid | 15 ml |
| Water to make | 1000 ml |
| pH | 6.00 |
| Color Developer: | |
| Water | 700 ml |
| Pentasodium Nitrilo-N,N,N-trimethylenephosphonate | 3 g |
| Sodium Sulfite | 7 g |
| Sodium Tertiary Phosphate 12-Hydrate | 36 g |
| Potassium Bromide | 1 g |
| Potassium Iodide (0.1% solution) | 90 ml |
| Sodium Hydroxide | 3 g |
| Citrazinic Acid | 1.5 g |
| N-ethyl-N-(β-methanesulfonamidoethyl)-3-methyl-4-aminoaniline Sulfate | 11 g |
| 3,6-Dithiooctane-1,8-diol | 1 g |
| Water to make | 1000 ml |
| pH | 11.80 |
| Adjusting Solution: | |
| Water | 700 ml |
| Sodium Sulfite | 12 g |
| Sodium Ethylenediaminetetra acetate Dihydrate | 8 g |
| Thioglycerine | 0.4 ml |
| Glacial Acetic Acid | 3 ml |
| Water to make | 1000 ml |
| pH | 6.60 |
| Bleaching Solution: | |
| Water | 800 ml |

-continued

| | |
|---|---|
| Sodium Ethylenediaminetetra-acetate Dihydrate | 2 g |
| Ammonium Ethylenediaminetetra-acetato/Iron(III) Dihydrate | 120 g |
| Potassium Bromide | 100 g |
| Water to make | 1000 ml |
| pH | 5.70 |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1000 ml |
| pH | 6.60 |

Rinsing Water

The same rinsing water as used in Example 7 was used.

| Stabilizing Solution: | |
|---|---|
| Water | 800 ml |
| Formalin (37 wt. %) | 5.0 ml |
| Fuji Drywell (surfactant, product by Fuji Photo Film Co.) | 5.0 ml |
| Water to make | 1000 ml |

TABLE 3

| Sample No. | Coupler | Side Absorption | Sharpness of Toe in Short-wave Side | Heat-Fastness | Remarks |
|---|---|---|---|---|---|
| 201 | A-1 | 0.177 | 0.227 | 76% | Comparative Sample |
| 202 | Coupler (2) | 0.076 | 0.183 | 93 | Sample of the Invention |
| 203 | Coupler (3) | 0.070 | 0.175 | 97 | Sample of the Invention |
| 204 | Coupler (9) | 0.076 | 0.182 | 92 | Sample of the Invention |
| 205 | Coupler (12) | 0.075 | 0.181 | 90 | Sample of the Invention |
| 206 | Coupler (13) | 0.076 | 0.180 | 91 | Sample of the Invention |
| 207 | Coupler (15) | 0.074 | 0.181 | 93 | Sample of the Invention |

As is obvious from the results in Table 3 above, the couplers of the present invention form dyes having a small side absorption and having a sharp toe in the shortwave side, and the dyes from the couplers had a high heat-fastness.

EXAMPLE 4

As a silver halide color photographic sample, there was used Sample No. 214 (multi-layered color paper) of Example 2 of European Pat. No. EP 0,355,660A2 (corresponding to JP-A-2-139544, U.S. Ser. No. 07/393,747), except that as a bisphenol compound, (III-10) was used in place of (III-23) of EPO 355660A2, and yellow coupler (ExY), image stabilizer (Cpd-8), solvent (Solv-6) and oxonole dyes were replaced by the following compounds, and the following microbicide Compounds Cpd-10 and Cpd-11 were incorporated, and cyan couplers in the fifth layer (red-sensitive emulsion layer) were replaced by the same molar amounts of Couplers (2), (3), (9), (12), (13) and (15) of the present invention.

(ExY) Yellow Coupler:
1/1 (by mol) mixture of the following compounds:
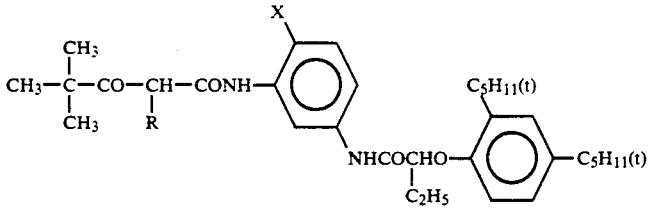
R = 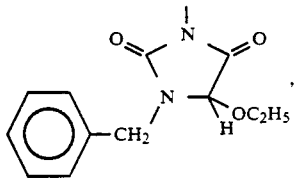 , X = Cl; R = 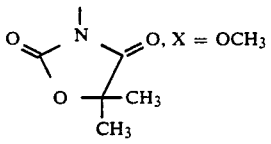
(Cpd-8) Color Image Stabilizer:
1/1 (by mol) mixture of the following compounds:
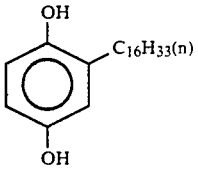
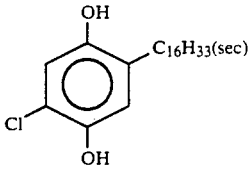
(Cpd-10) Microbicide:
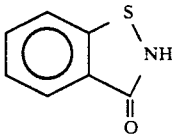
(25.0 mg/m$^2$)
(Cpd-11) Microbicide:
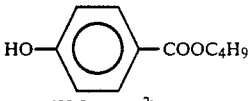
(50.0 mg/m$^2$)
(Solv-6) Solvent:
9/1 (by weight) mixture of the following compounds:
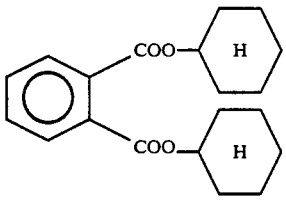
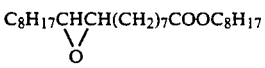
Oxonole Dyes:

-continued

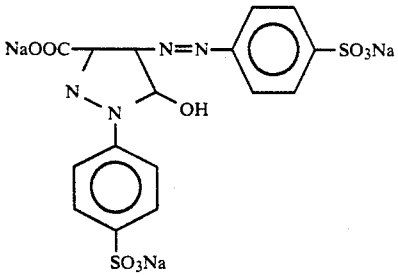

(10 mg/m²)

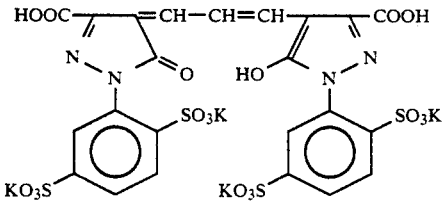

(10 mg/m²)

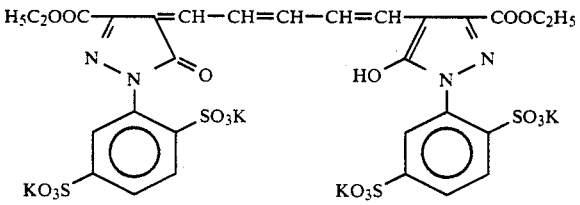

(40 mg/m²)

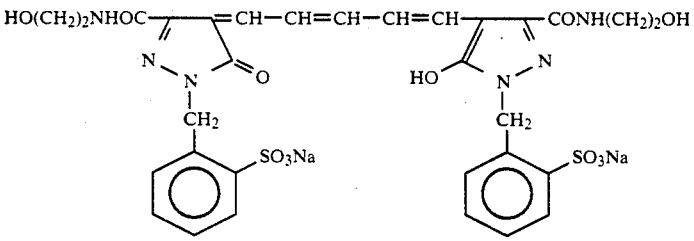

(20 mg/m²)

The color photographic material sample thus prepared was processed in accordance with the process of Example 2.

The processed sample was then evaluated in the same manner as in Example 1. As a result, the sample showed an excellent color reproducibility (especially in reproduction of green color) and the image formed had an excellent heat-fastness.

As will be understood from the above-mentioned explanation, the new cyan couplers of formula (I) of the present invention give excellent cyan dyes and cyan images having satisfactory absorption characteristic and color fastness. They can be used for forming photographic cyan images and, in particular, can be incorporated into silver halide color photographic materials.

While the invention has been described in detail and with reference to specific embodiments thereof, it will be apparent to one skilled in the art that various changes and modifications can be made therein without departing from the spirit and scope thereof.

What is claimed is:

1. A method of forming a cyan dye image in an exposed silver halide color photographic material comprising a support and a photosensitive silver halide emulsion, said method comprising developing the exposed silver halide color photographic material with a color developing solution containing an aromatic primary amine color developing agent in the presence of a cyan coupler represented by formula (I):

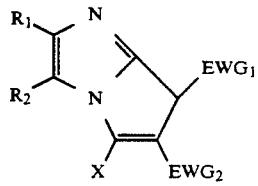

(I)

wherein $EWG_1$ and $EWG_2$ each represents an electron attractive group having a Hammett's substituent constant $\sigma_p$ value of at least 0.30;

$R_1$ represents a hydrogen atom or a substituent;

$R_2$ represents a substituent;

X represents a hydrogen atom or a group capable of splitting off by a coupling reaction with an oxidation product of an aromatic primary amine color developing agent;

$R_1$ and $R_2$ may be bonded to each other to form a ring; and provided that $R_2$ must not be a halogen atom.

2. The method of forming a cyan dye image as in claim 1, wherein said $\sigma_p$ value is at least 0.50.

3. The method of forming a cyan dye image as in claim 1, wherein said $\sigma_p$ value is not more than 1.0.

4. The method of forming a cyan dye image as in claim 1, wherein said $\sigma_p$ value is not more than 0.70.

5. The method of forming a cyan dye image as in claim 1, wherein $EWG_1$, and $EWG_2$ each represents a cyano group, a nitro group, an aliphatic- or aromatic-acyl group, a carbamoyl group, a phosphono group, an alkoxycarbonyl group, a phosphoryl group, a sulfamoyl group, an aliphatic- or aromatic-sulfonyl group, or a perfluoroalkyl group, or substituted groups thereof.

6. The method of forming a cyan dye image as in claim 5, wherein the substituent of said substituted groups is at least one group selected from the group consisting of a halogen atom, a hydroxy group, a cyano group, a carboxy group, an alkyl group, a cyoloalkyl group, an aralkyl group, an aryl group, a heterocyclic group, an alkoxy group, an aryloxy group, an amino group, an acylamino group, an aliphatic- or an aromatic-sulfonylamino group, an acyl group, an aliphaic- or an aromatic- sulfonyl group, a carbamoyl group, a sulfamoyl group, a ureido group, an urethane group, an alkylthio group, an arylthio group, a nitro group, and an alkoxycarbonyl group, and substituted groups thereof which are substituted with at least one of them.

7. The method of forming a cyan dye image as in claim 6, wherein said heterocyclic group is a 5 to 7-membered heterocyclic group containing at least one of N, O and S atoms with the proviso that the total numbers of N atom, O atom and S atom are 1 to 4, 0 to 1, and 0 to 1, respectively.

8. The method of forming a cyan dye image as in claim 1, wherein $R_1$ represents hydrogen atom, a halogen atom, an aliphatic group having from 1 to 36 carbon atoms, an aromatic group, a heterocyclic group, an alkoxy group, an aryloxy group, an alkenyloxy group, an amino group, an acyl group, an ester group, an amido group, a sulfamoylamino group, an imido group, an ureido group, an aliphatic- or aromatic-sulfonyl group, an aliphatic- or aromatic-thio group, a hydroxyl group, a cyano group, a carboxyl group, a nitro group, or a sulfo group; or substituted groups thereof; and $R_1$ and $R_2$ may be bonded to each other to form a ring.

9. The method of forming a cyan dye image as in claim 8, wherein the substituent of said substituted groups is at least one group selected from the group consisting of a halogen atom, a hydroxy group, a cyano group, a carboxy group, an alkyl group, a cyoloalkyl group, an aralkyl group, an aryl group, a heterocyclic group, an alkoxy group, an aryloxy group, an amino group, an acylamino group, an aliphatic- or an aromatic-sulfonylamino group, an acyl group, an aliphaic- or an aromatic- sulfonyl group, a carbamoyl group, a sulfamoyl group, a ureido group, an urethane group, an alkylthio group, an arylthio group, a nitro group, and an alkoxycarbonyl group, and substituted groups thereof which are substituted with at least one of the above described substituents.

10. The method of forming a cyan dye image as in claim 1, $R_2$ represents an aliphatic group having from 1 to 36 carbon atoms, an aromatic group, a heterocyclic group, an alkoxy group, an aryloxy group, an alkenyloxy group, an amino group, an acyl group, an ester group, an amido group, a sulfamoylamino group, an imido group, an ureido group, an aliphatic- or aromatic-sulfonyl group, an aliphatic- or aromatic-thio group, a hydroxyl group, a cyano group, a carboxyl group, a nitro group, or a sulfo group; or substituted groups thereof; and $R_1$ and $R_2$ may be bonded to each other to form a ring.

11. The method of forming a cyan dye image as in claim 10, wherein the substituent of said substituted groups is at least one group selected from the group consisting of a halogen atom, a hydroxy group, a cyano group, a carboxy group, an alkyl group, a cyoloalkyl group, an aralkyl group, an aryl group, a heterocyclic group, an alkoxy group, an aryloxy group, an amino group, an acylamino group, an aliphatic- or an aromatic-sulfonylamino group, an acyl group, an aliphaic- or an aromatic- sulfonyl group, a carbamoyl group, a sulfamoyl group, a ureido group, an urethane group, an alkylthio group, an arylthio group, a nitro group, and an alkoxycarbonyl group, and substituted groups thereof which are substituted with at least one of the above described substituents.

12. The method of forming a cyan dye image as in claim 1, wherein X represents a hydrogen atom, a halogen atom, an alkoxy group, an aryloxy group, an acyloxy group, an aliphatic- or aromatic-sulfonyloxy group, an acylamino group, an aliphatic or aromatic sulfonamido group, an alkoxycarbonyloxy group, an aryloxycarbonyloxy group, an aliphatic-, aromatic- or heterocyclic-thio group, a carbamoylamino group, a 5-membered or 6-membered nitrogen-containing heterocyclic group, an imido group, an aromayic azo group, or a carboxyl group; substituted groups thereof; or a group which is bonded to the remainder of formula (I) via a carbon atom to form a bis-type coupler.

13. The method of forming a cyan dye image as in claim 12, wherein the substituent of said substituted groups is at least one group selected from the group consisting of a halogen atom, a hydroxy group, a cyano group, a carboxy group, an alkyl group, a cyoloalkyl group, an aralkyl group, an aryl group, a heterocyclic group, an alkoxy group, an aryloxy group, an amino group, an acylamino group, an aliphatic- or an aromatic-sulfonylamino group, an acyl group, an aliphaic- or an aromatic- sulfonyl group, a carbamoyl group, a sulfamoyl group, a ureido group, an urethane group, an alkylthio group, an arylthio group, a nitro group, and an alkoxycarbonyl group, and substituted groups thereof which are substituted with at least one of the above described substituents.

14. The method of forming a cyan dye image as in claim 1, wherein the cyan dye has a maximum absorption wavelength of 580 to 720 nm.

15. The method of forming a cyan dye image as in claim 1, wherein said cyan dye forming coupler is incorporated in a silver halide color photographic material.

16. The method of forming a cyan dye image as in claim 15, wherein said cyan dye forming coupler is an alkaline aqueous solution soluble coupler and is incorporated in a color developing solution for development of a silver halide color photographic material.

17. The method of forming a cyan dye image as in claim 1, wherein said cyan dye forming coupler is incorporated in a silver halide color photographic material in an amount of $1\times10^{-3}$ to 1 mol per mol of silver halide.

18. The method of forming a cyan dye image as in claim 15, wherein said cyan dye forming coupler is incorporated in a color developing solution for development of a silver halide color photographic material in an amount of 0.0005 to 0.05 mol per liter of the color developing solution.

19. A silver halide color photographic material comprising a support and at least one red-sensitive silver halide emulsion layer containing at least one cyan dye forming coupler represented by formula (I):

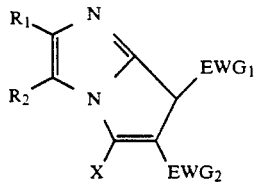

(I)

wherein $EWG_1$ and $EWG_2$ each represents an electron attracting group having a Hammett's substituent constant $\sigma_p$ value of at least 0.30;

$R_1$ represents a hydrogen atom or a substituent;

$R_2$ represents a substituent;

X represents a hydrogen atom or a group capable of splitting off by a coupling reaction with an oxidation product of an aromatic primary amine compound;

$R_1$ and $R_2$ may be bonded to each other to form a ring; and provided that $R_2$ must not be a halogen atom.

20. The silver halide color photographic material as in claim 19, wherein said cyan dye forming coupler is incorporated in said red-sensitive emulsion layer in an amount of $1\times10^{-3}$ to 1 mol per mol of silver halide.

* * * * *